US010571855B2

(12) United States Patent
Mochizuki et al.

(10) Patent No.: US 10,571,855 B2
(45) Date of Patent: Feb. 25, 2020

(54) IMAGE FORMING APPARATUS CAPABLE OF REGULATING DETACHMENT OF DEVELOPER STORAGE PORTION, METHOD FOR RELEASING DETACHMENT REGULATION OF DEVELOPER STORAGE PORTION

(71) Applicant: KYOCERA Document Solutions Inc., Osaka-shi, Osaka (JP)

(72) Inventors: Masayuki Mochizuki, Osaka (JP); Tsuyoshi Terada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/368,635

(22) Filed: Mar. 28, 2019

(65) Prior Publication Data

US 2019/0302686 A1 Oct. 3, 2019

(30) Foreign Application Priority Data

Mar. 29, 2018 (JP) ..... 2018-064919

(51) Int. Cl.
*G03G 15/00* (2006.01)
*G03G 15/08* (2006.01)
(Continued)

(52) U.S. Cl.
CPC ..... *G03G 21/1839* (2013.01); *G03G 15/0872* (2013.01); *G03G 21/1647* (2013.01); *G03G 21/1652* (2013.01); *G03G 2221/1654* (2013.01)

(58) Field of Classification Search
CPC ..... G03G 15/0858; G03G 15/0863; G03G 15/0865; G03G 15/0867; G03G 15/0872; G03G 21/1676
(Continued)

(56) References Cited

U.S. PATENT DOCUMENTS 8,396,379 B2 * 3/2013 Tsukijima ..... G03G 15/0865 399/27
9,921,542 B2 * 3/2018 Mochizuki et al. ..... G03G 15/0872
(Continued)

FOREIGN PATENT DOCUMENTS

JP 2017138466 A 8/2017

*Primary Examiner* — William J Royer
(74) *Attorney, Agent, or Firm* — Alleman Hall Creasman & Tuttle LLP

(57) ABSTRACT

An image forming apparatus includes lock mechanisms, a regulation processing portion, and a second release processing portion. The lock mechanisms correspond to attachment portions to each of which a developer storage portion is attached, and each regulate detachment of a developer storage portion attached to an attachment portion. When a first state where developer storage portions of a specific type are attached to all the attachment portions, has been detected, and there is a lock mechanism that is not regulating detachment, the regulation processing portion causes the lock mechanism to regulate detachment of the developer storage portion. When a second state where a developer storage portion of the specific type has not been attached to at least one attachment portion, has been detected, and all the lock mechanisms are regulating detachment, the second release processing portion causes all the lock mechanisms to release regulation of detachment.

6 Claims, 15 Drawing Sheets

(51) Int. Cl.
*G03G 21/18* (2006.01)
*G03G 21/16* (2006.01)

(58) Field of Classification Search
USPC ..... 399/12, 13, 27
See application file for complete search history.

(56) References Cited

U.S. PATENT DOCUMENTS

| | | | | |
|---|---|---|---|---|
| 9,996,023 | B2 * | 6/2018 | Seto | G03G 21/1676 |
| 2017/0219986 | A1 | 8/2017 | Murata | |

* cited by examiner

IMAGE FORMING APPARATUS CAPABLE OF REGULATING DETACHMENT OF DEVELOPER STORAGE PORTION, METHOD FOR RELEASING DETACHMENT REGULATION OF DEVELOPER STORAGE PORTION

INCORPORATION BY REFERENCE

This application is based upon and claims the benefit of priority from the corresponding Japanese Patent Application No. 2018-064919 filed on Mar. 29, 2018, the entire contents of which are incorporated herein by reference.

BACKGROUND

The present disclosure relates to an image forming apparatus capable of regulating detachment of a developer storage portion(s), and to a method implemented in an image forming apparatus to release detachment regulation of a developer storage portion(s).

There is known an image forming apparatus including a lock mechanism that is configured to regulate detachment of developer storage portions that store developer. In this type of image forming apparatus, so as to reduce the remaining amount of developer stored in a developer storage portion when it is replaced with a new one, detachment of the developer storage portion is regulated until shortage of developer stored in the developer storage portion is detected.

In addition, in an image forming apparatus, if the developer stored in a developer storage portion attached to the apparatus is unconformable to the apparatus, the quality of the image printed by the apparatus may be degraded. As a result, in the image forming apparatus, it may be determined whether or not each of the developer storage portions attached to the apparatus is a developer storage portion of a specific type storing developer that is conformable to the apparatus.

For example, there is known, as a related technology, an image forming apparatus that determines whether or not a developer storage portion attached to an attachment portion of the image forming apparatus has a predetermined shape corresponding to the image forming apparatus. Specifically, in the developer storage portion of the specific type corresponding to the image forming apparatus, a protruding portion has insulation, protruding in an attachment direction in which the developer storage portion is attached to the apparatus, is provided at an end portion of the developer storage portion on the downstream side in the attachment direction. In addition, the image forming apparatus is provided with a pair of metal terminals that come in contact with the attachment portions. When the developer storage portion of the specific type is attached to the attachment portion, the protruding portion is inserted between the pair of metal terminals and the pair of metal terminals are separated from each other. The image forming apparatus includes a detection circuit in which all the pairs of metal terminals are connected in parallel, and based on whether or not the detection circuit is conductive, it is determined whether or not each of all the developer storage portions is the developer storage portion of the specific type.

SUMMARY

An image forming apparatus according to an aspect of the present disclosure includes a plurality of attachment portions, a plurality of lock mechanisms, a detection processing portion, a first release processing portion, a plurality of detection electrodes, a detection circuit, a regulation processing portion, and a second release processing portion. A developer storage portion storing developer used for printing is attached to each of the plurality of attachment portions. The plurality of lock mechanisms are respectively provided in correspondence with the plurality of attachment portions and are each configured to regulate detachment of a developer storage portion attached to a corresponding one of the attachment portions. The detection processing portion is configured to detect whether or not any one of the plurality of attachment portions is in a specific state where a remaining amount of toner stored in a developer storage portion attached to the attachment portion is smaller than a predetermined lower-limit amount. The first release processing portion is configured to, when the detection processing portion has detected that one of the plurality of attachment portions is in the specific state, cause a lock mechanism corresponding to the attachment portion detected to be in the specific state, to release regulation of detachment of the developer storage portion attached to the attachment portion in the specific state. The plurality of detection electrodes are respectively provided in correspondence with the plurality of attachment portions and are each configured to switch its status between being conducted and being not conducted when a developer storage portion of a predetermined specific type is attached to a corresponding attachment portion. In the detection circuit, all of the plurality of detection electrodes are connected in series or in parallel, and the detection circuit is configured to detect whether or not developer storage portions of the specific type are attached to all of the plurality of attachment portions. The regulation processing portion is configured to, when the detection circuit has detected a first state where developer storage portions of the specific type are attached to all of the plurality of attachment portions, and there is a lock mechanism that is not regulating detachment of a developer storage portion, cause the lock mechanism to regulate detachment of the developer storage portion. The second release processing portion is configured to, when the detection circuit has detected a second state where there is at least one attachment portion to which a developer storage portion of the specific type has not been attached, and all of the plurality of lock mechanisms are regulating detachment of the developer storage portions, cause all of the plurality of lock mechanisms to release regulation of detachment of the developer storage portions.

A method for releasing detachment regulation of a developer storage portion(s) according to another aspect of the present disclosure is implemented in an image forming apparatus that includes a plurality of attachment portions to each of which a developer storage portion storing developer used for printing is attached, a plurality of lock mechanisms respectively provided in correspondence with the plurality of attachment portions and each configured to regulate detachment of a developer storage portion attached to a corresponding one of the plurality of attachment portions, a plurality of detection electrodes respectively provided in correspondence with the plurality of attachment portions and each configured to switch its status between being conducted and being not conducted when a developer storage portion of a predetermined specific type is attached to a corresponding attachment portion, and a detection circuit in which all of the plurality of detection electrodes are connected in series or in parallel and which is configured to detect whether or not developer storage portions of the specific type are attached to all of the plurality of attachment portions, and the method includes: detecting whether or not any one of the plurality of attachment portions is in a specific state where a remaining amount of toner stored in a developer storage portion attached to the attachment portion is smaller than a predetermined lower-limit amount; when the detecting has detected that one of the plurality of attachment portions is in the specific state, causing a lock mechanism corresponding to the attachment portion in the specific state, to release regulation of detachment of a developer storage portion attached to the attachment portion in the specific state; when the detection circuit has detected a first state where developer storage portions of the specific type are attached to all of the plurality of attachment portions, and there is a lock mechanism that is not regulating detachment of a developer storage portion, causing the lock mechanism to regulate detachment of the developer storage portion; and when the detection circuit has detected a second state where there is at least one attachment portion to which a developer storage portion of the specific type has not been attached, and all of the plurality of lock mechanisms are regulating detachment of the developer storage portions, causing all of the plurality of lock mechanisms to release regulation of detachment of the developer storage portions.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an image forming apparatus 100 with reference to the accompanying drawings. In the following description, an up-down direction D1 is defined based on a state where the image forming apparatus 100 is installed. In addition, a front-rear direction D2 is defined on a supposition that a side from which a toner container 300 is inserted to the image forming apparatus 100 is a front side. Furthermore, a left-right direction D3 is defined by viewing the image forming apparatus 100 from the front side.

[Configuration of Image Forming Apparatus 100]

The image forming apparatus 100 has at least a print function and is, for example, a color printer. The image forming apparatus 100 prints an image on a print sheet that is a sheet member, by using developer that contains toner (an example of the developer of the present disclosure). It is noted that a specific example of the image forming apparatus 100 is, for example, a printer, a copier, a facsimile, or a multifunction peripheral having functions of these apparatuses. In addition, although the image forming apparatus 100 is configured to form a color image, the image forming apparatus may be configured to form a monochrome image as far as it uses the toner container 300.

Figure 1:
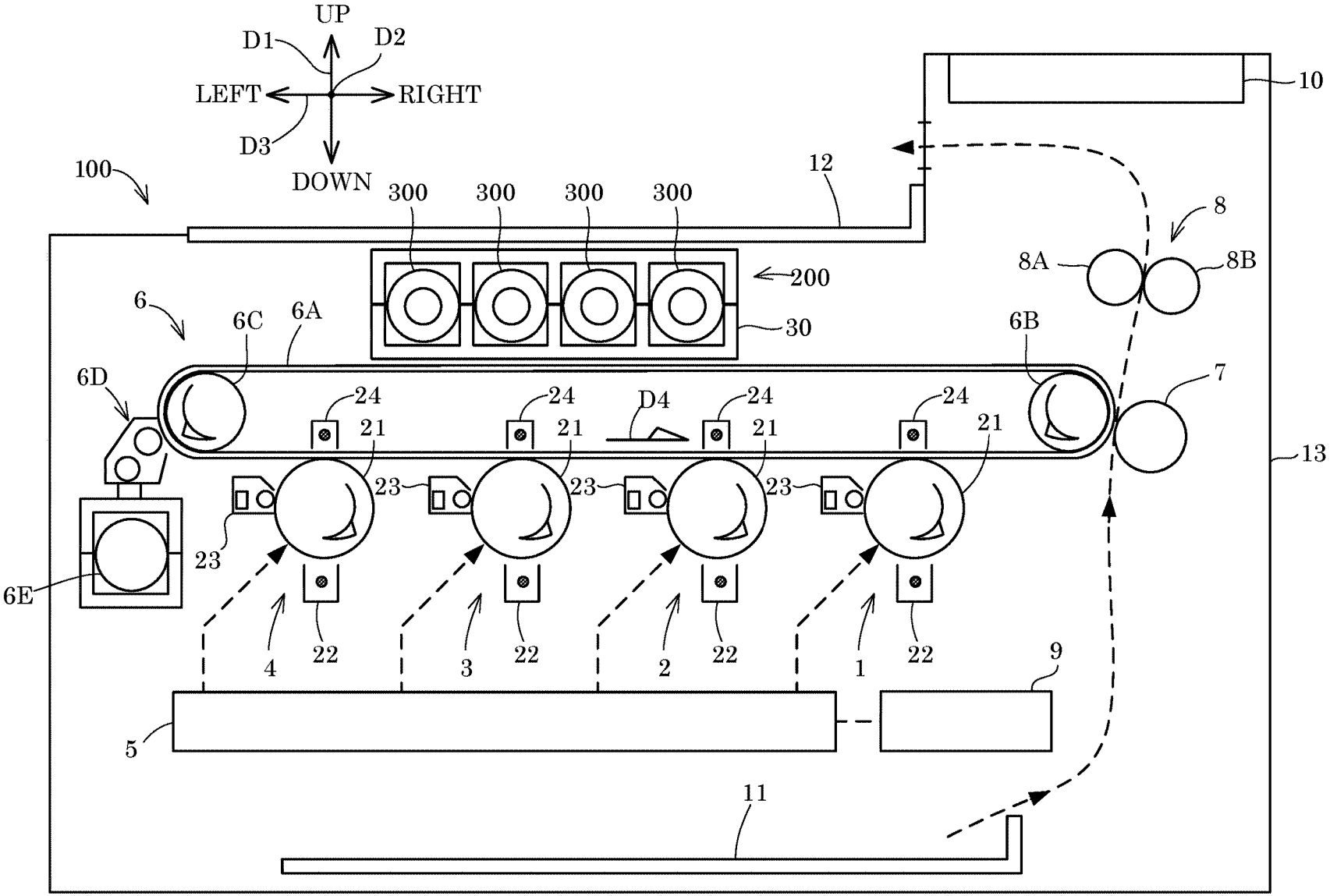
FIG. 1 is a diagram showing a configuration of an image forming apparatus according to an embodiment of the present disclosure.

As shown in FIG. 1, the image forming apparatus 100 is a so-called tandem-system color image forming apparatus.

The image forming apparatus 100 includes a plurality of image forming portions 1 to 4, an exposure device 5, an intermediate transfer unit 6, a secondary transfer device 7, a fixing device 8, a control portion 9, an operation/display portion 10, a sheet feed tray 11, a sheet discharge tray 12, and a toner supply device 200. These components are attached to a housing 13 that constitutes an external frame (not shown), an internal frame and the like of the image forming apparatus 100.

The image forming portions 1 to 4 form, by a so-called electrophotographic system, toner images of different colors respectively on a plurality of photoconductor drums 21 that are arranged in alignment. The toner images are transferred to an intermediate transfer belt 6A while it is running (moving) such that the toner images are overlaid with each other thereon. In the example shown in FIG. 1, an image forming portion 1 for black, an image forming portion 2 for yellow, an image forming portion 3 for cyan, and an image forming portion 4 for magenta are arranged in alignment in the stated order from the downstream side in a moving direction D4 of the intermediate transfer belt 6A.

The image forming portions 1 to 4 are provided below the intermediate transfer belt 6A. Each of the image forming portions 1 to 4 includes a photoconductor drum 21 carrying a toner image thereon, a charging device 22, a developing device 23, and a primary transfer device 24. The surface of the photoconductor drum 21 is charged by the charging device 22, and the charged surface of the photoconductor drum 21 is exposure-scanned by the exposure device 5. This allows an electrostatic latent image to be formed on the surface of the photoconductor drum 21. The developing device 23 develops the electrostatic latent image with the toner. Subsequently, the toner image on the photoconductor drum 21 is transferred to the intermediate transfer belt 6A by the primary transfer device 24.

The intermediate transfer unit 6 includes the intermediate transfer belt 6A, a driving roller 6B, a driven roller 6C, and a belt cleaning device 6D. The intermediate transfer belt 6A carries a toner image that is formed from toner images of a plurality of (in the present embodiment, four) colors. The intermediate transfer belt 6A is supported and rotationally driven by the driving roller 6B and the driven roller 6C so as to move while its surface is in contact with surfaces of the photoconductor drums 21. When the intermediate transfer belt 6A is rotationally driven, its surface passes between the photoconductor drums 21 and the primary transfer devices 24. During that movement, the toner images of the different colors carried on the plurality of photoconductor drum 21 are transferred in sequence to the intermediate transfer belt 6A in such a way as to be overlaid with each other thereon.

The toner supply device 200 is provided above the intermediate transfer unit 6. The toner supply device 200 includes a container attachment portion 30 to which four toner containers 300 for colors black, yellow, cyan, and magenta are attached. The container attachment portion 30 is configured such that the toner containers 300 are detachable therefrom. The configuration of the toner supply device 200 is described below.

The secondary transfer device 7 transfers the toner image from the intermediate transfer belt 6A to a print sheet conveyed from the sheet feed tray 11. The print sheet on which the toner image has been transferred is conveyed by a conveyance portion (not shown) to the fixing device 8. The fixing device 8 includes a heating roller 8A and a pressure roller 8B. The fixing device 8 conveys the print sheet on which the toner image has been transferred, while applying heat and pressure thereto. This allows the toner image to be fused and fixed to the print sheet. The print sheet to which the toner image has been fixed is further conveyed to the downstream side, and discharged to and held by the sheet discharge tray 12 that is disposed above the intermediate transfer unit 6.

The belt cleaning device 6D removes and collects waste toner, namely toner that has remained on the surface of the intermediate transfer belt 6A, and discharges the collected waste toner to a waste toner container 6E.

The control portion 9 includes control equipment such as CPU, ROM, RAM, and EEPROM that are not shown. The CPU is a processor that executes various calculation processes. The ROM is a nonvolatile storage device in which various information such as control programs for causing the CPU to execute various processes are stored in advance. The RAM is a volatile storage device, and the EEPROM is a nonvolatile storage device. The RAM and the EEPROM are used as a temporary storage memory (working area) for the various processes executed by the CPU. In the control portion 9, the CPU executes the various control programs stored in advance in the ROM. This allows the image forming apparatus 100 to be controlled comprehensively by the control portion 9. It is noted that the control portion 9 may be formed as an electronic circuit such as an integrated circuit (ASIC), and may be a control portion provided independently of a main control portion that comprehensively controls the image forming apparatus 100.

The operation/display portion 10 includes a display portion and an operation portion, wherein the display portion is, for example, a liquid crystal display and displays various types of information in response to control instructions from the control portion 9, and the operation portion is, for example, operation keys or a touch panel for inputting various types of information to the control portion 9 in response to user operations.

[Toner Supply Device 200]

Figure 2:
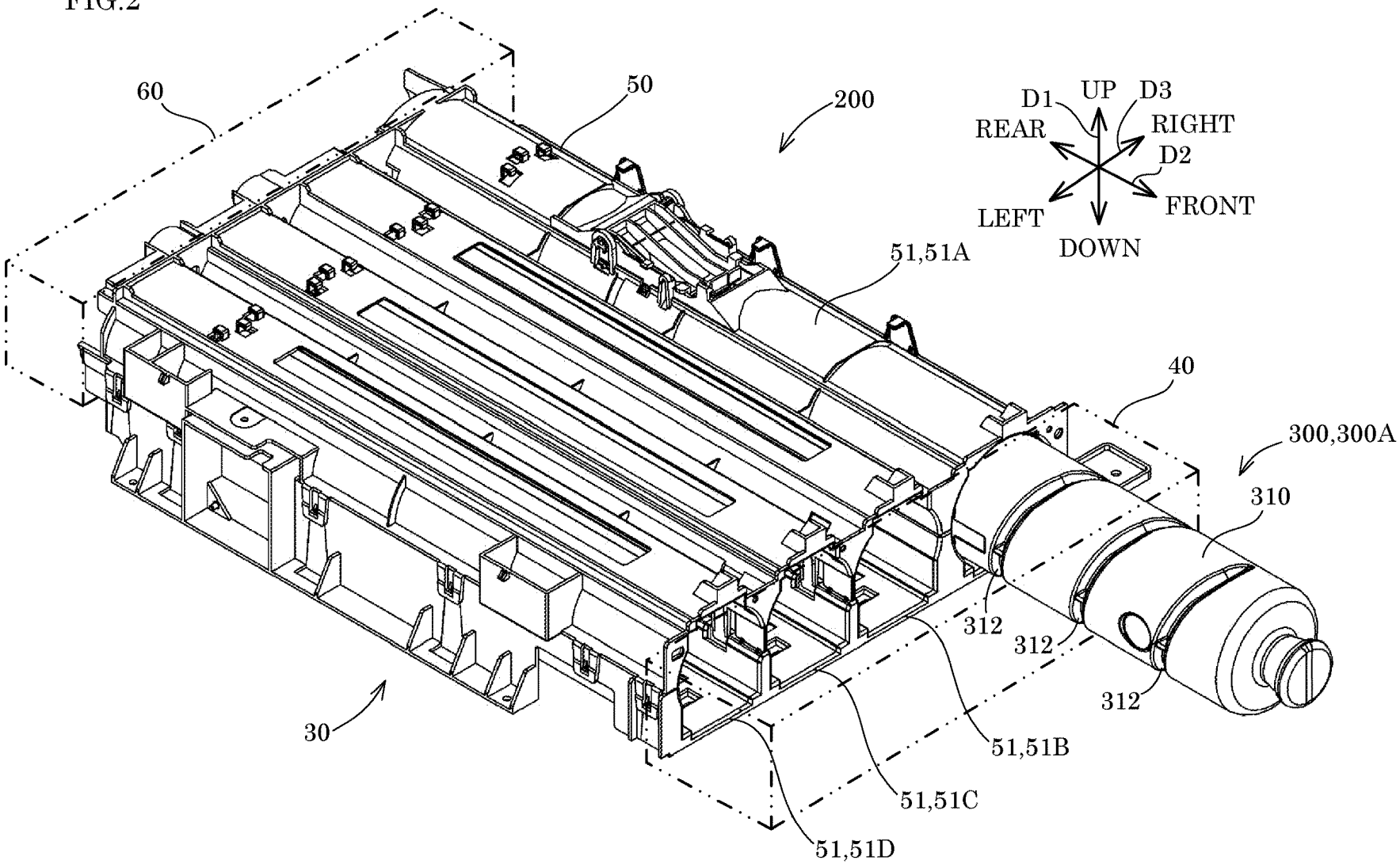
FIG. 2 is a perspective diagram showing a configuration of a toner supply device included in the image forming apparatus according to the embodiment of the present disclosure.

In the following, the toner supply device 200 is described with reference to FIG. 2 to FIG. 11. As shown in FIG. 2, the toner supply device 200 includes the toner containers 300 (an example of developer storage portions of the present disclosure) and the container attachment portion 30 to which the toner containers 300 are attached. It is noted that in the drawings, based on an attachment attitude in which the toner supply device 200 is attached to the housing 13, a vertical direction is defined as the up-down direction D1, the attachment/detachment direction (insertion/removal direction) of the toner containers 300 with respect to the housing 13 is defined as the front-rear direction D2 (an insertion direction D21, a removal direction D22), and a horizontal direction when viewed from the front side of the toner supply device 200 is defined as the left-right direction D3.

The toner containers 300 store toner that is to be supplied to the developing device 23. In the present embodiment, four toner containers 300 corresponding to the colors black, yellow, cyan and magenta are provided in the toner supply device 200. It is noted that the toner container 300 for black has a larger external diameter than the toner containers 300 for the other colors, but except for this, all the toner containers 300 have the same configuration. In the following description, the toner container 300 refers to the toner container 300 for black unless otherwise mentioned.

Figure 5:
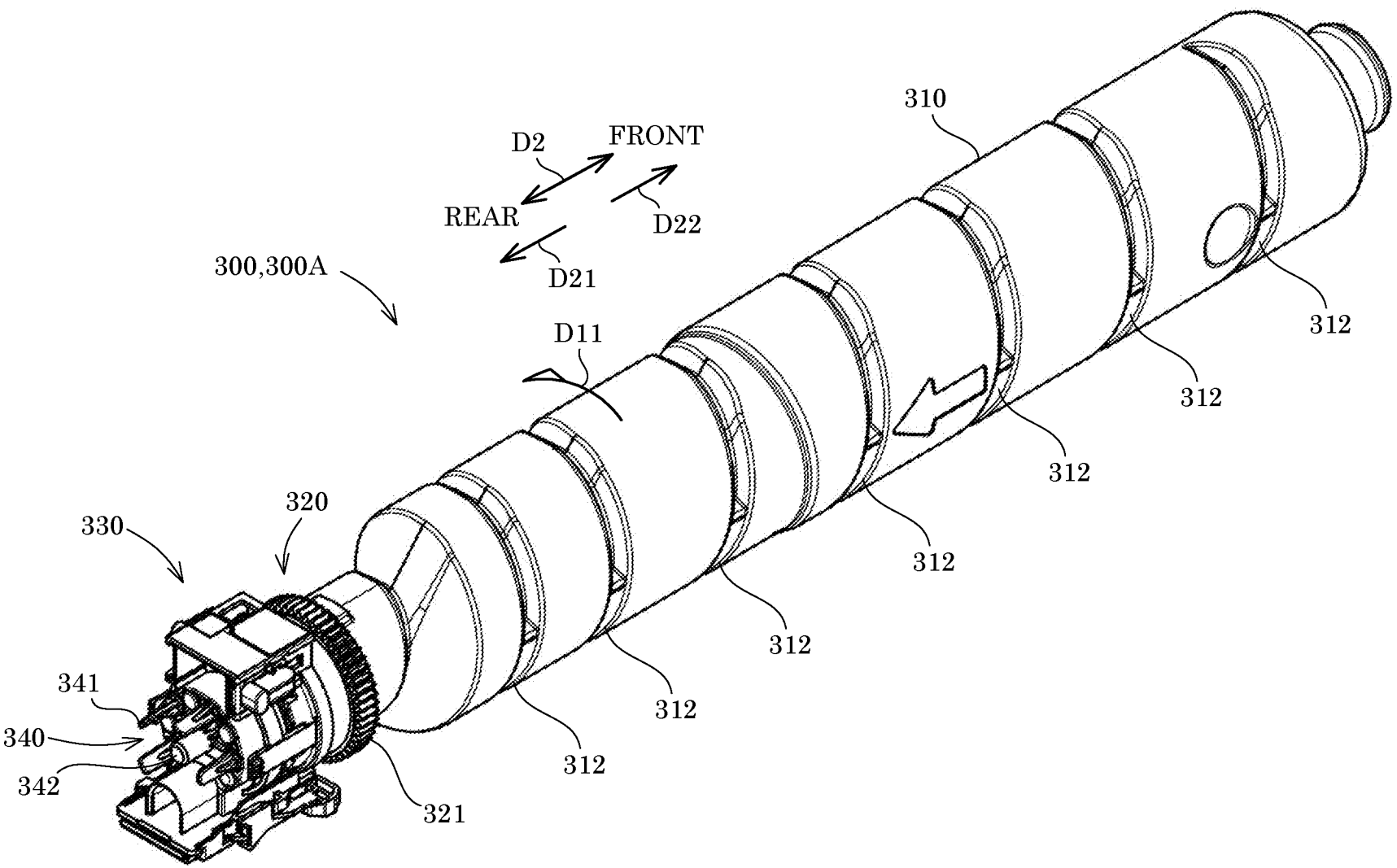
FIG. 5 is a perspective diagram showing a configuration of a toner container attached to the image forming apparatus according to the embodiment of the present disclosure.

As shown in FIG. 5, the toner container 300 is elongated in the front-rear direction D2. The toner container 300 includes a container main body 310, a drive transmission portion 320, and a cover member 330. The inside of the container main body 310 is a storage space for storing toner. The toner is stored in the inside of the container main body 310. The container main body 310 has, at one of opposite ends thereof (on the rear side), an opening portion 311 (see FIG. 7) through which the toner can flow in and out. The opening portion 311 is formed at an end of the toner container 300 in an insertion direction D21 (an example of an attachment direction of the present disclosure) side (on the rear side), wherein the toner container 300 is inserted in the toner supply device 200 in the insertion direction D21. The toner stored inside can flow out through the opening portion 311. The container main body 310 is formed in a cylindrical shape with the other end (the front-end side) being closed.

The rear-end portion of the container main body 310 is formed to be tapered in the insertion direction D21. The opening portion 311 is formed at an end of the container main body 310 on the insertion direction D21 side. The opening portion 311 is circular in a cross section. The container main body 310 is made of, for example, a synthetic resin such as polyethylene terephthalate (PET resin) by the blow molding method or the injection molding method.

The container main body 310 includes an angled rib 312 (see FIG. 5) that is formed in a spiral shape on the inner surface of the container main body 310. The angled rib 312 projects from the inner surface of the container main body 310 toward the center of the container main body 310. The angled rib 312 has a role of conveying the toner in the container main body 310 toward the opening portion 311 (see FIG. 7).

Figure 6:
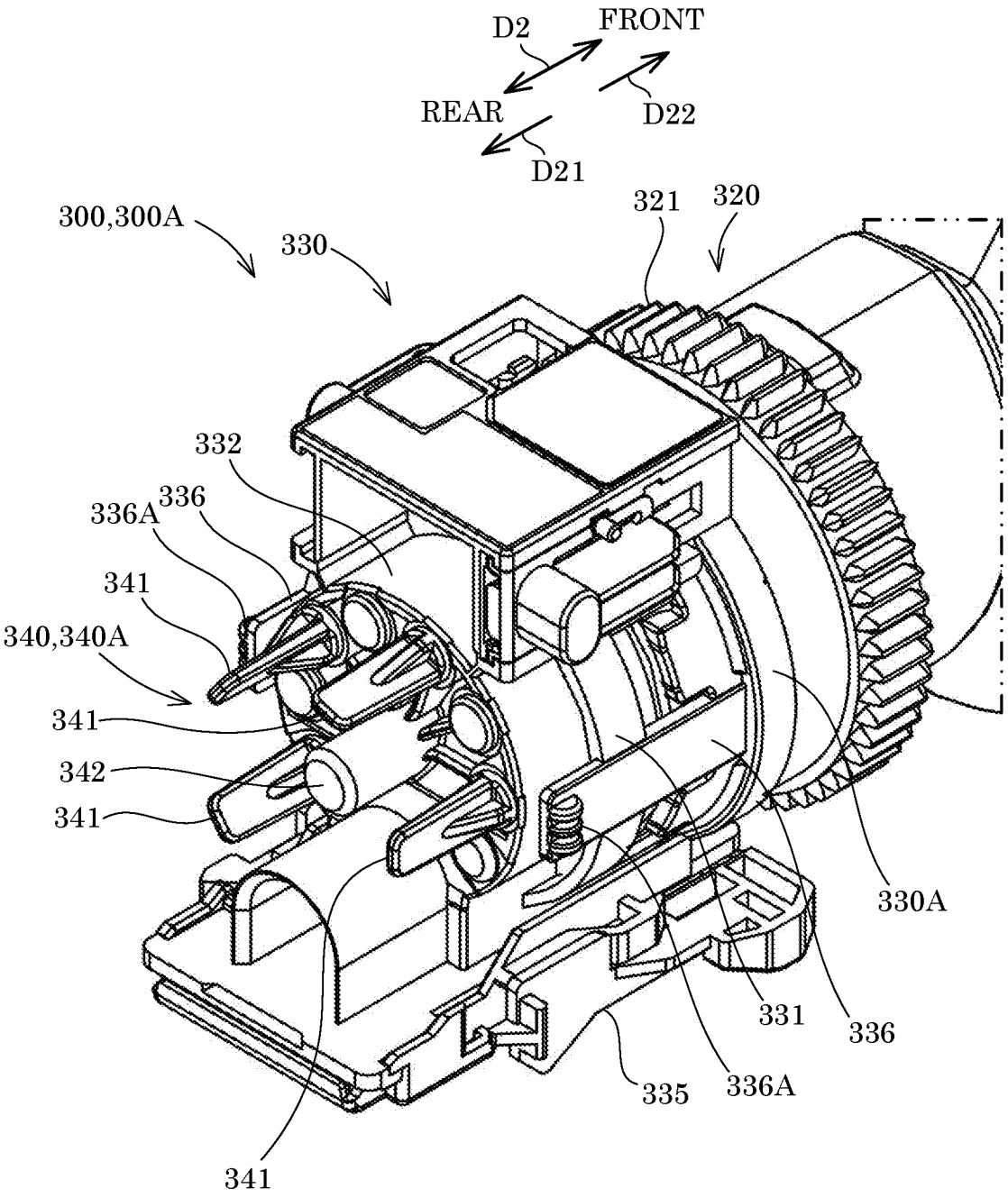
FIG. 6 is a perspective diagram showing a configuration of a rear end portion of the toner container attached to the image forming apparatus according to the embodiment of the present disclosure.

As shown in FIG. 6, the drive transmission portion 320 is attached to the opening portion 311 side of the container main body 310. The drive transmission portion 320 is fixed to the container main body 310. The drive transmission portion 320 is an annular member with a gear 321 formed on its circumferential surface. The drive transmission portion 320 is fitted in an end portion of the container main body 310 on the opening portion 311 side, and is fixed to the circumferential surface thereof. Upon receiving a rotational driving force from a drive source such as a motor, the drive transmission portion 320 transmits the rotational driving force to the toner container 300.

In the container main body 310, the cover member 330 is provided more on the insertion direction D21 side (more on the rear side) than the drive transmission portion 320. The cover member 330 is provided to cover the opening portion 311, and is attached to the end portion of the container main body 310 on the insertion direction D21 side. The cover member 330 is a synthetic resin product formed from a synthetic resin having thermoplasticity, by the injection molding or the like.

Figure 7:
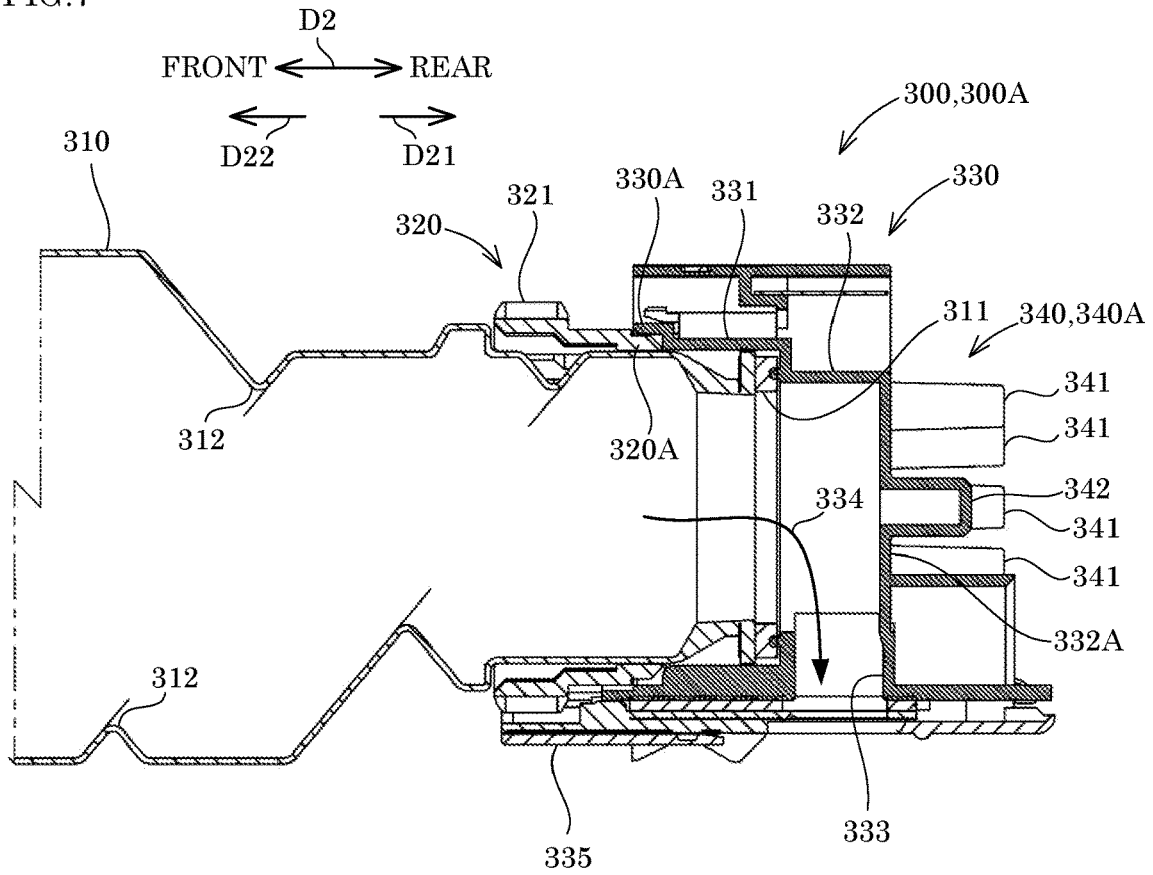
FIG. 7 is a cross-sectional diagram showing a configuration of the rear end portion of the toner container attached to the image forming apparatus according to the embodiment of the present disclosure.

The cover member 330 includes a storage frame 331 of a cylindrical shape in which the opening portion 311 is inserted in a state where the cover member 330 is attached to the container main body 310 (see FIG. 7). As shown in FIG. 7, the opening portion 311 is inserted in the storage frame 331 so as to be covered therewith. The storage frame 331 supports the opening portion 311 in such a manner that the opening portion 311 can pivot in the circumferential direction. As a result, in the state where the opening portion 311 is inserted in the storage frame 331, the container main body 310 can pivot in the circumferential direction.

When the toner container 300 is attached to the container attachment portion 30 (see FIG. 2), a coupling portion 340 (see FIG. 5) included in the cover member 330 is engaged with a coupled portion 61 (see FIG. 9) included in the container attachment portion 30, and the toner container 300 is attached to the container attachment portion 30, wherein the coupling portion 340 and the coupled portion 61 are described below. With the engagement of the coupling portion 340 and the coupled portion 61, the cover member 330 is fixed with respect to the circumferential direction of the toner container 300. In the present embodiment, in the state where the toner container 300 is attached to the container attachment portion 30, the cover member 330 cannot be rotated in the circumferential direction, while the container main body 310 is supported in the container attachment portion 30 so as to be pivotable in the circumferential direction. A front end portion 330A of the cover member 330 is loosely fitted on a rear end portion 320A of the drive transmission portion 320 (see FIG. 7). As a result, in the state where the toner container 300 is attached to the container attachment portion 30, when the rotational driving force is transmitted to the gear 321, the container main body 310 is rotated in a rotation direction indicated by the arrow D11 (see FIG. 5) by the rotational driving force. That is, the toner container 300 rotates around its longitudinal direction in the state where toner can be supplied to the developing device 23. When the container main body 310 of the toner container 300 rotates in this way, the toner is pushed by the angled rib 312 and conveyed toward the opening portion 311 side (the rear side).

The cover member 330 includes a toner discharge port 333 (see FIG. 7). The toner discharge port 333 is provided so as to discharge the toner stored in the container main body 310 to the outside, and is provided in the outer circumferential wall of the cover member 330. The toner discharge port 333 is provided below the cover member 330 as shown in FIG. 7. Specifically, the toner discharge port 333 is a rectangular through hole penetrating through the outer circumferential wall of the cover member 330. As shown in FIG. 7, a toner flow passage 334 is formed inside the cover member 330 between the opening portion 311 and the toner discharge port 333. When the toner container 300 is attached to the container attachment portion 30 (see FIG. 2) with the toner discharge port 333 on the lower side, the toner, having moved from the opening portion 311 of the container main body 310 to the toner flow passage 334, is guided through the toner flow passage 334 downward and reaches the toner discharge port 333. Here, when the toner discharge port 333 is opened, the toner is discharged from the toner discharge port 333 to the lower outside. This allows the toner to be supplied to the developing device 23. On the other hand, when the toner discharge port 333 is closed, the toner is not discharged, and the toner flow passage 334 is filled with toner.

As shown in FIG. 7, the cover member 330 includes a slide-type opening/closing member 335. The opening/closing member 335 is a plate-like member, and is supported by the cover member 330 in such a way as to be slidable in the longitudinal direction of the container main body 310 (the front-rear direction D2). The opening/closing member 335 opens or closes the toner discharge port 333 depending on the position of the toner container 300 with respect to the container attachment portion 30. When the toner container 300 is attached to the container attachment portion 30, the opening/closing member 335 opens the toner discharge port 333. Specifically, when the toner container 300 is attached to the container attachment portion 30, the opening/closing member 335 receives a pressing force of the attachment operation from the container attachment portion 30, and is moved to a position (opening position) where the opening/closing member 335 opens the toner discharge port 333. FIG. 7 shows a state where the opening/closing member 335 has moved to the front side and opened the toner discharge port 333. When the toner container 300 is detached from the container attachment portion 30, the opening/closing member 335 moves rearward with the removal operation from the opening position to a position (closing position) where the toner discharge port 333 is closed, and the opening/closing member 335 closes the toner discharge port 333.

As shown in FIG. 6, the cover member 330 includes a base portion 332 more on the insertion direction D21 side than the storage frame 331, wherein the base portion 332 is cylindrical and hollow inside. The base portion 332 is integrally formed with the coupling portion 340 that is described below.

In addition, a projection 342 is integrally formed with an end surface 332A that is on the insertion direction D21 side of the base portion 332, at the center of the end surface 332A. The projection 342 is engaged with a hole 66A (see FIG. 10) of a protruding boss 66 provided on a coupling supporting portion 60 of the container attachment portion 30, when the toner container 300 is attached to a corresponding holding portion 51. Specifically, the projection 342 is inserted in the hole 66A. This allows the projection 342 and the protruding boss 66 to be engaged with each other, and the toner container 300 is positioned to an attachment position defined in the holding portion 51.

As shown in FIG. 6, the cover member 330 includes engaging portions 336 extending in the insertion direction D21 from the end portion 330A. The engaging portions 336 are provided on the left and right sides of the storage frame 331 to sandwich the storage frame 331. Tip ends of the engaging portions 336 in the insertion direction D21 are respectively provided with arc-shaped claw portions 336A. When the toner container 300 is attached to the holding portion 51, the claw portions 336A are, by snap-fitting, engaged with claw portions 69A of engaged portions 69 (see FIG. 9) provided on the coupling supporting portion 60 of the container attachment portion 30. The engagement of the claw portions 336A and the claw portions 69A regulates the movement in the insertion direction D21 of the toner container 300 attached to the holding portion 51.

As shown in FIG. 2, the container attachment portion 30 includes a lock unit 40, a holding case 50, and the coupling supporting portion 60, wherein the holding case 50 includes four holding portions 51 (51A to 51D), and the coupling supporting portion 60 is attached to the rear end surface of the holding case 50. It is noted that in FIG. 2, the lock unit 40 and the coupling supporting portion 60 are represented by two-dot chain lines.

The toner containers 300 storing toner of predetermined colors are respectively attached to the holding portions 51 of the holding case 50. The toner container 300 for black is attached to the rightmost holding portion 51A. FIG. 2 shows a state where a part of the rear-side portion of the toner container 300 for black is inserted in the holding portion 51. The toner containers 300 for yellow, cyan and magenta are respectively attached to the holding portions 51B, 51C and 51D disposed on the left side of the holding portion 51A.

The lock unit 40 is configured to regulate the detachment of the toner container 300 attached to the holding portion 51. The lock unit 40 is formed as a separate member from the holding case 50, and is installed in front of the holding case 50. It is noted that the lock unit 40 and the holding case 50 may be formed integrally with each other in the container attachment portion 30.

Figure 3:
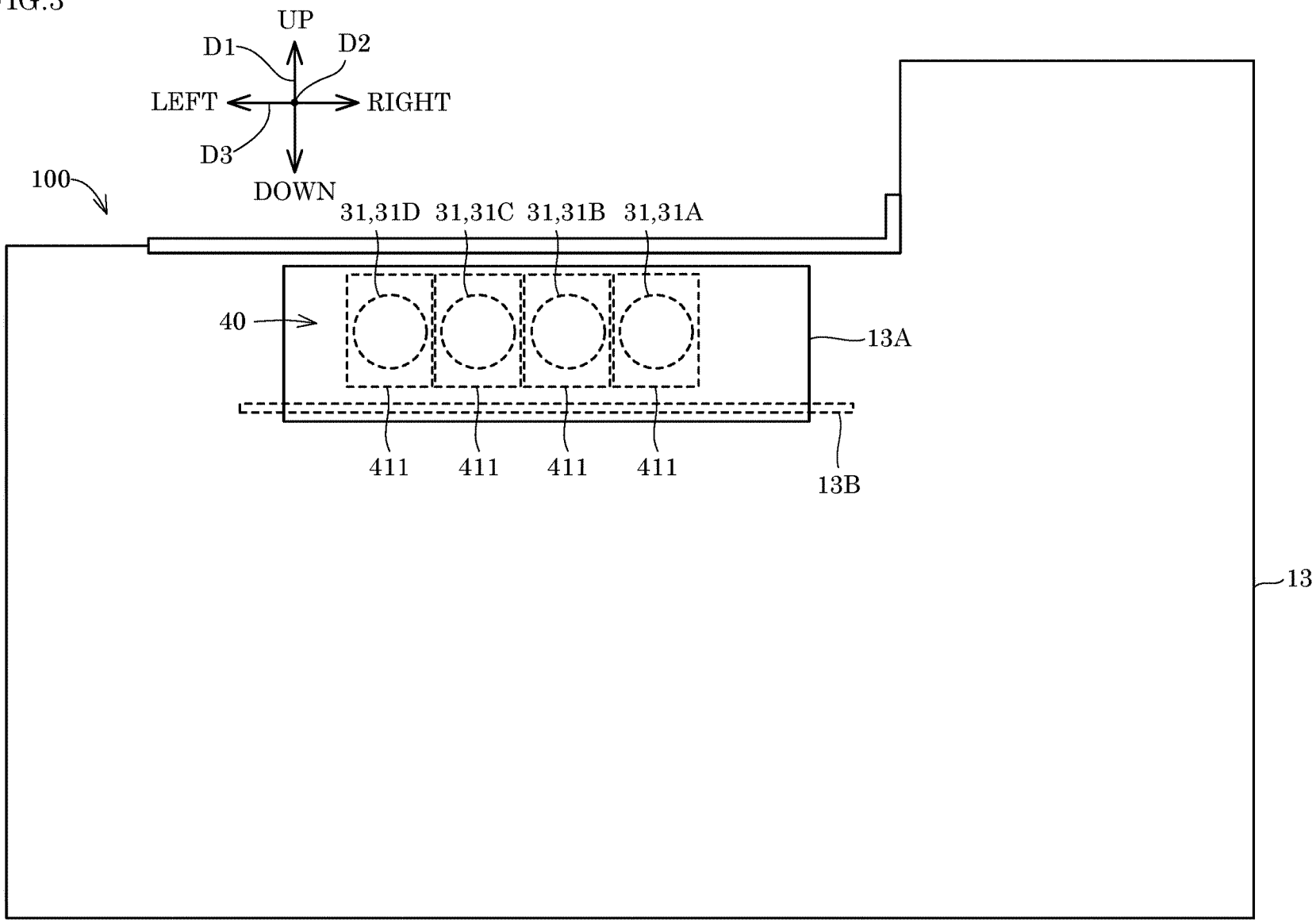
FIG. 3 is a front diagram showing a configuration of a housing included in the image forming apparatus according to the embodiment of the present disclosure.

As shown in FIG. 3, a front cover 13A is provided in front of the housing 13. The front cover 13A is positioned to face the lock unit 40. The front cover 13A is, at its lower part, pivotably supported by a pivot shaft 13B which extends parallel to the left-right direction. That is, the front cover 13A is opened as the upper part of the front cover 13A pivots frontward. It is noted that the image forming apparatus 100 includes an opening/closing sensor 13C (see FIG. 18), such as an optical sensor, for detecting opening/closing of the front cover 13A.

As shown in FIG. 3, the container attachment portion 30 includes four opening portions 31 (31A to 31D) that respectively correspond to the four holding portions 51. The rightmost opening portion 31A is communicated with the holding portion 51A. The opening portions 31B, 31C, and 31D provided on the left side of the opening portion 31A are respectively communicated with the holding portions 51B, 51C, and 51D. When a toner container 300 is attached to a holding portion 51, the toner container 300 is inserted in the opening portion 31. The four opening portions 31 are provided on the inner side of the front cover 13A.

Figure 4:
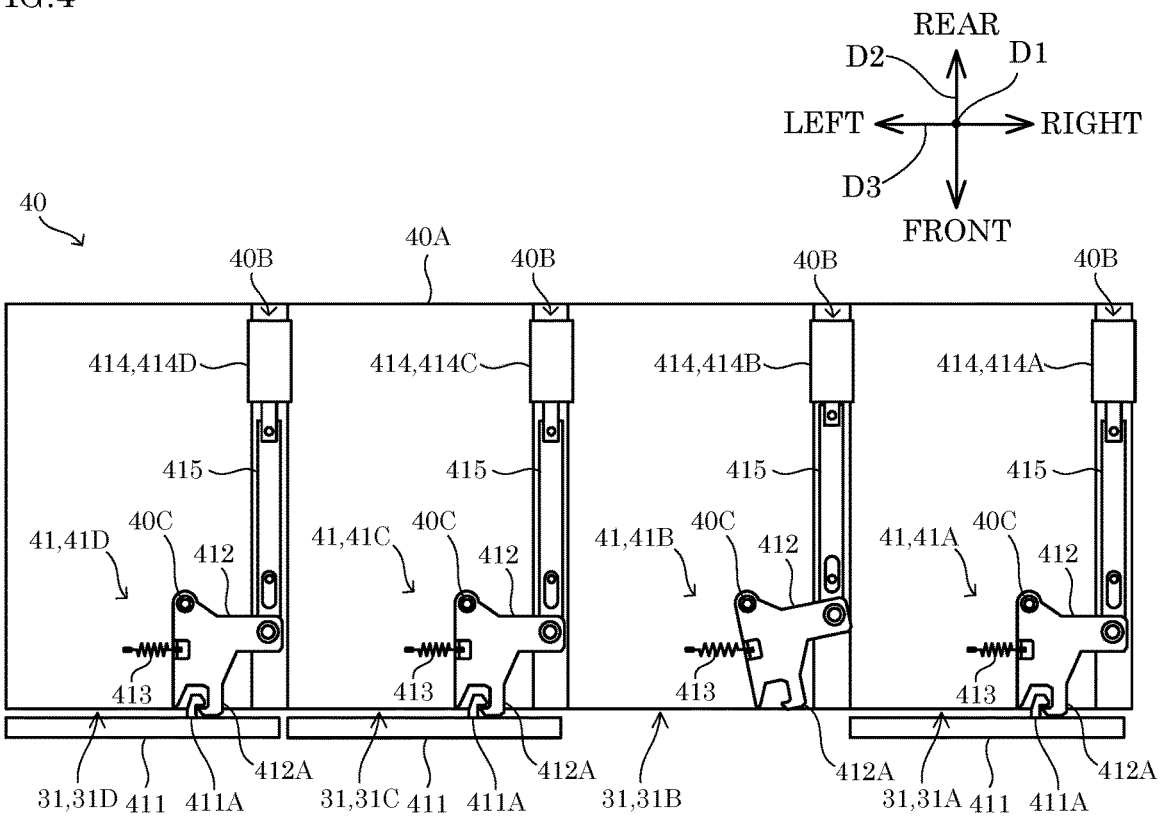
FIG. 4 is a plan diagram showing a configuration of a lock unit included in the image forming apparatus according to the embodiment of the present disclosure.

As shown in FIG. 4, the lock unit 40 includes four lock mechanisms 41 (41A to 41D) and a frame member 40A. The lock mechanisms 41 are configured to switch between presence and absence of the restriction of opening/closing of the opening portions 31 individually. The frame member 40A forms a top part of the opening portions 31. The upper surface of the frame member 40A has four concave portions 40B that are formed along the front-rear direction in correspondence with the four opening portions 31 respectively.

As shown in FIG. 4, each of the lock mechanisms 41 includes a lock cover 411, a restriction member 412, a coil spring 413, a solenoid 414 (respectively, 414A to 414D), and a link member 415. In each of the lock mechanisms 41, the restriction member 412, the coil spring 413, and the solenoid 414 are provided on the upper surface of the frame member 40A. In addition, in each of the lock mechanisms 41, the link member 415 is provided on the corresponding concave portion 40B of the frame member 40A. Since the lock mechanisms 41A to 41D have a common configuration, the following description deals with the lock mechanism 41A that corresponds to the opening portion 31A, as a representative of the lock mechanisms 41A to 41D.

The lock cover 411 is provided at the opening portion 31A, and opens and closes the opening portion 31A. The lock cover 411 is, at its lower part, pivotably supported by a pivot shaft that is provided in a frame member (not shown) forming the bottom part of the opening portions 31 and extends parallel to the left-right direction D3. That is, as is the case with the front cover 13A, the lock cover 411 is opened as the upper part thereof pivots frontward. It is noted that FIG. 4 shows a state where the lock cover 411 is opened with respect to the opening portion 31B.

An engaged portion 411A is provided on the upper part of the lock cover 411 so as to be engaged with an engaging portion 412A of the restriction member 412. As shown in FIG. 4, the engaged portion 411A is formed in a shape of a hook that projects from the rear surface of the lock cover 411 and curves rightward.

The restriction member 412 includes the engaging portion 412A which is configured to be engaged with the engaged portion 411A of the lock cover 411. As shown in FIG. 4, the engaging portion 412A is formed in a shape of a hook that projects frontward and curves leftward. The restriction member 412 is pivotably provided on the upper surface of the frame member 40A. Specifically, the restriction member 412 is pivotably supported by a pivot shaft 40C provided on the upper surface of the frame member 40A.

The restriction member 412 is configured to pivot between a lock position and a release position, wherein when the restriction member 412 is at the lock position, opening of the lock cover 411 is restricted, and when the restriction member 412 is at the release position, the restriction (lock) on the opening of the lock cover 411 is released. Here, as shown in FIG. 4, when the restriction member 412 is at the lock position, the engaging portion 412A is engaged with the engaged portion 411A of the lock cover 411 that is in the closing state. In addition, the release position is more on the inner side of the lock cover 411 than the lock position, and when the restriction member 412 is at the release position, the engagement between the engaging portion 412A and the engaged portion 411A of the lock cover 411 is released (see the lock mechanism 41B in FIG. 4). In the lock mechanism 41A, opening of the lock cover 411 is restricted by the restriction member 412, thereby the detachment of the toner container 300 from the holding portion 51A is regulated.

The coil spring 413 biases the restriction member 412 toward the lock position. Specifically, as shown in FIG. 4, the coil spring 413 is provided to extend in the left-right direction D3 on the upper surface of the frame member 40A. One of opposite ends of the coil spring 413 in the longitudinal direction is fixed to the left-side portion of the restriction member 412, and the other end is fixed to the upper surface of the frame member 40A. The coil spring 413 is fixed to the restriction member 412 and the upper surface of the frame member 40A in a state where it is stretched to be longer than its natural length. As a result, the restriction member 412 is pulled leftward by the coil spring 413, and biased toward the lock position.

As shown in FIG. 4, the solenoid 414 is provided more on the inner side of the lock cover 411 than the restriction member 412. The solenoid 414 is driven in accordance with the power supply and moves the restriction member 412 to the release position. Specifically, the driven solenoid 414 is a so-called pull type and includes a plunger that is elongated along the front-rear direction D2. The plunger is coupled with the restriction member 412 via the link member 415 that is elongated along the front-rear direction D2.

The solenoid 414 drives the plunger rearward in accordance with power supplied from a power source (not shown) based on a control command from the control portion 9. This allows the restriction member 412 to be moved from the lock position to the release position via the link member 415, and the lock of the lock cover 411 is released (see the lock mechanism 41B in FIG. 4).

The coupling supporting portion 60 is provided so as to position the toner containers 300 to the attachment positions in the holding portions 51 by being coupled with the toner containers 300 attached to the holding portions 51. The coupling supporting portion 60 is provided independently of the holding case 50, and is attached to the holding case 50 or to an inner frame in the housing 13. The coupling supporting portion 60 includes four coupled portions 61 respectively in correspondence with the four holding portions 51. It is noted that the container attachment portion 30 may be the coupling supporting portion 60 and the holding case 50 that are integrally formed with each other.

In the present embodiment, the image forming apparatus 100 is configured such that a toner container 300 storing toner unconformable to the image forming apparatus 100 cannot be attached thereto. That is, the image forming apparatus 100 is configured such that only a toner container 300 (an example of a developer storage portion of a specific type) having attachment compatibility with a holding portion 51 can be attached to the holding portion 51. In other words, each holding portion 51 selectively allows a toner container 300 having attachment compatibility therewith to be attached thereto. For this purpose, in the present embodiment, the coupling portion 340 is provided at a tip end portion of the toner container 300 in the insertion direction D21, and the coupled portion 61 is provided on the coupling supporting portion 60. When a toner container 300 is inserted in a holding portion 51, and the coupling portion 340 of the toner container 300 is engaged with the coupled portion 61, the attachment of the toner container 300 is permitted. On the other hand, when the coupling portion 340 of the toner container 300 cannot be engaged with the coupled portion 61, the attachment of the toner container 300 is prohibited. Such a configuration for realizing the attachment compatibility between the coupled portion 61 and the coupling portion 340 is generally called an incompatibility structure.

In the following, the configuration of the coupling portion 340 is described.

As shown in FIG. 6 and FIG. 7, the coupling portion 340 is provided on the end surface 332A of the base portion 332 of the cover member 330. Here, FIG. 6 shows the tip of the toner container 300 for black that is inserted in the holding portion 51A for black. Hereinafter, for the sake of explanation, the toner container 300 for black is referred to as a toner container 300A, and the coupling portion 340 provided in the toner container 300A is referred to as a coupling portion 340A. The coupling portion 340A is provided on the tip of the toner container 300A in the insertion direction D21. The coupling portion 340 is provided not only in the toner container 300A for black, but also in each of the toner containers 300 for yellow, cyan, and magenta, and those coupling portions 340 are formed in the same shape. In the following, as a representative of the coupling portions 340 for the respective colors, the coupling portion 340A for black is described with reference to FIG. 6.

As shown in FIG. 6, the coupling portion 340A is integrally provided with the cover member 330 of the toner container 300A. As described above, the cover member 330 includes the base portion 332 that is cylindrical and hollow inside. The coupling portion 340A is provided on the end surface 332A of the base portion 332. The coupling portion 340A is integrally formed with the cover member 330 when the cover member 330 is molded.

The coupling portion 340A includes four compatible keys 341 (an example of a protruding portion of the present disclosure). The four compatible keys 341 are positioned so as to be engaged with the coupled portion 61A for black. The compatible keys 341 are protruding members that protrude from the end surface 332A in the insertion direction D21 (namely, toward the coupled portion 61A), and each of the compatible keys 341 has a flat tip. The compatible keys 341 are made of an insulator that does not allow electricity to pass through it. The four compatible keys 341 are formed at positions where they do not interfere with interference keys 70 (see FIG. 10) that are provided on the coupled portion 61, in the attachment state where the toner container 300A is attached to the holding portion 51A of the container attachment portion 30.

Figure 8:
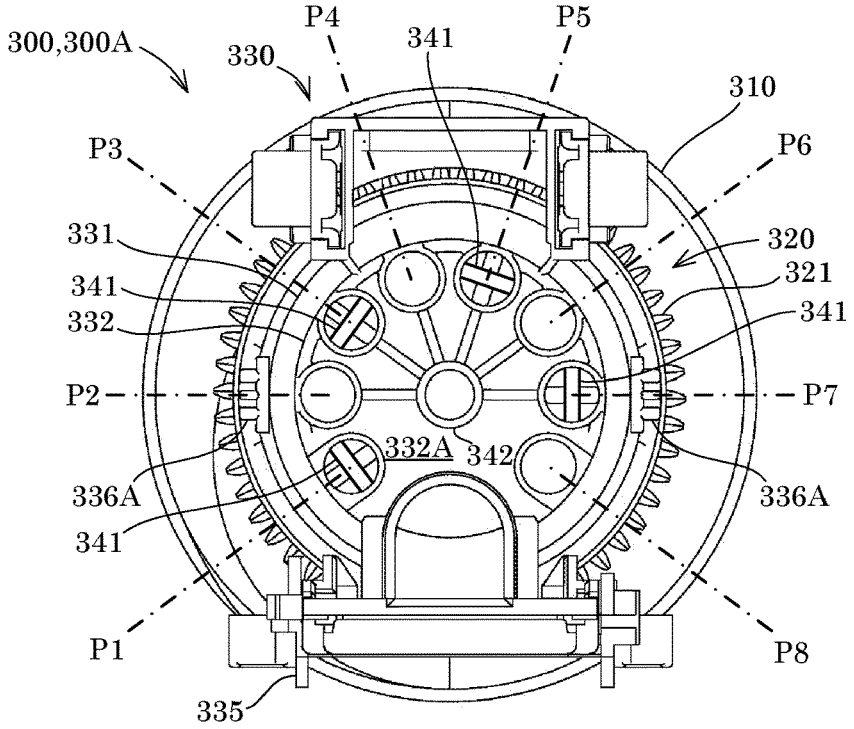
FIG. 8 is a rear diagram showing a configuration of the rear end portion of the toner container attached to the image forming apparatus according to the embodiment of the present disclosure.

In the present embodiment, as the positions on which the compatible keys 341 can be disposed, the positions P1 to P8 are defined on the circumference of a circle around the projection 342, as shown in FIG. 8. The positions P1 to P8 are the same positions in each of the coupling portions 340 of the toner containers 300, and are defined on the circumference at an equal angle interval based on the projection 342. That is, the positions P1 to P8 are arranged to form an arc shape along the circumference in the coupling portion 340A. In the example shown in FIG. 8, on the end surface 332A, the position P1 is defined to be adjacent to the bottom of the center of the end surface 332A in the CW (clockwise) direction, and the positions P2 to P8 are defined at an equal angle interval from the position P1 in the CW direction. As shown in FIG. 8, the positions P1 to P8 are arranged symmetrically with respect to a vertical line passing through the center of the projection 342. In the toner container 300A, the four compatible keys 341 are provided at positions P1, P3, P5 and P7 among the positions P1 to P8. In other words, the four compatible keys 341 are arranged to form an arc shape on the end surface 332A of the coupling portion 340A.

Next, configurations of the coupling supporting portion 60 and the coupled portion 61 are described.

Figure 9:
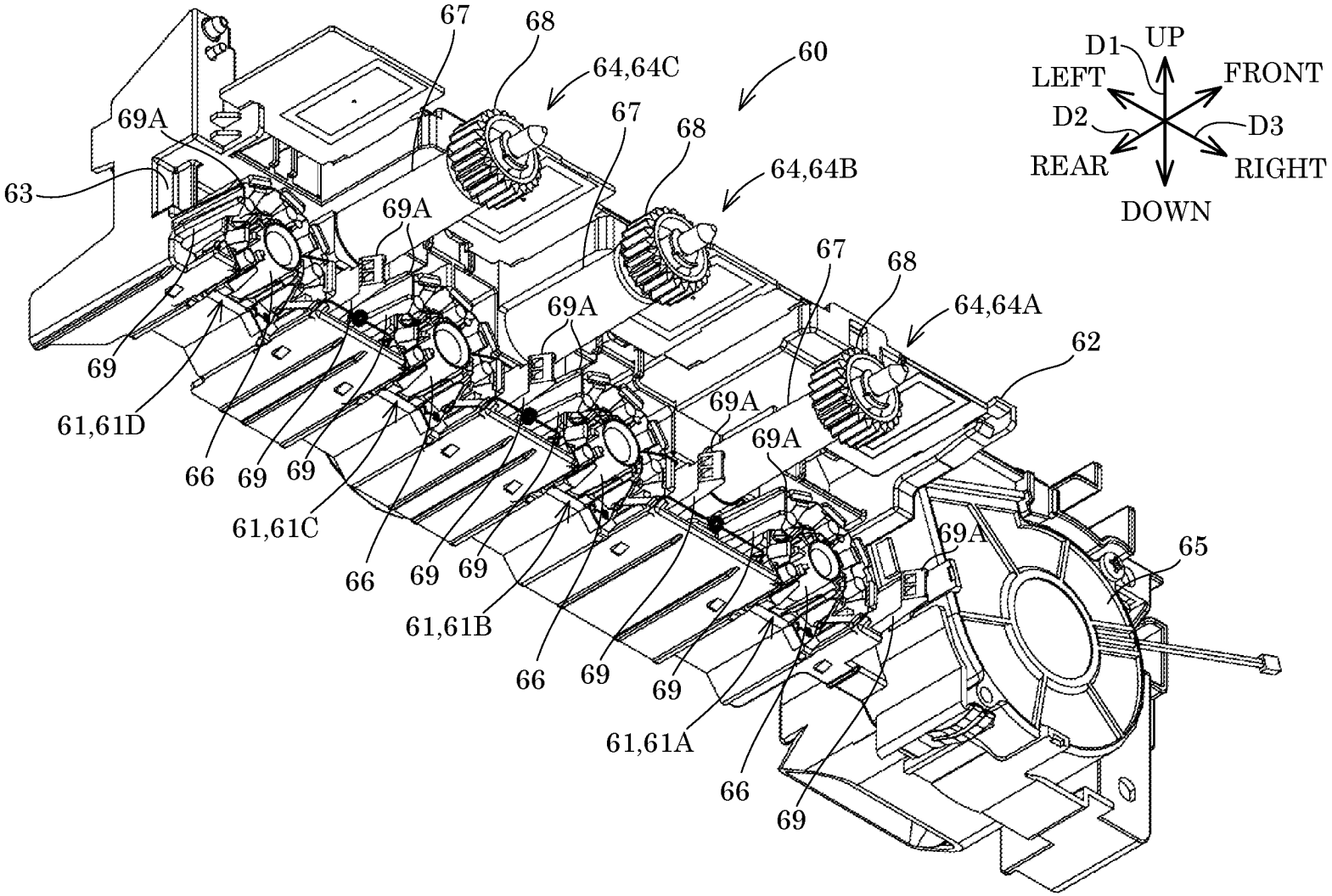
FIG. 9 is a perspective diagram showing a configuration of a coupling supporting portion included in the image forming apparatus according to the embodiment of the present disclosure.

As shown in FIG. 9, the coupling supporting portion 60 includes a frame 62 that can be attached to the rear end surface of the holding case 50. The frame 62 is formed to be elongated in the left-right direction D3. On an attachment surface 63 which is a front surface of the frame 62, four coupled portions 61 (61A to 61D), three drive transmission portions 64 (64A to 64C), a blower fan 65, and eight engaged portions 69 are attached.

The four coupled portions 61 are aligned on a straight line in the longitudinal direction of the frame 62. The rightmost coupled portion 61A is coupled with the toner container 300 for black. The coupled portions 61B, 61C, and 61D disposed on the left side of the coupled portion 61A are respectively coupled with the toner containers 300 for yellow, cyan, and magenta.

Each of the drive transmission portions 64 receives a rotational driving force from a drive source such as a motor in the housing 13, and transmits the rotational driving force to the gear 321 of the toner container 300. Each of the drive transmission portions 64 includes a support portion 67 and a gear 68, wherein the support portion 67 is cylindrical and projects perpendicularly from the attachment surface 63, and the gear 68 is rotationally supported by the support portion 67.

The drive transmission portion 64A is provided in the vicinity of the coupled portion 61A, and when the toner container 300 for black is attached to the holding portion 51A, the gear 68 is coupled with the gear 321. The drive transmission portion 64B is provided in the vicinity of the coupled portion 61B, and when the toner container 300 is attached to the holding portion 51B, the gear 68 of the drive transmission portion 64B is coupled with the gear 321. The drive transmission portion 64C is provided between the coupled portion 61C and the coupled portion 61D, and when toner containers 300 are attached to the holding portion 51C and the holding portion 51D, the gear 68 of the drive transmission portion 64C is coupled with the gears 321 of the toner containers 300.

The eight engaged portions 69 are aligned on a straight line in the longitudinal direction of the frame 62. The engaged portions 69 project perpendicularly from the attachment surface 63. Tip ends of the engaged portions 69 are respectively provided with the claw portions 69A. The eight engaged portions 69 are divided into four pairs which each sandwich a coupled portion 61. A pair of engaged portions 69 sandwiching a coupled portion 61 are engaged with two engaging portions 336 of a toner container 300 which is coupled with the coupled portion 61.

Figure 10:
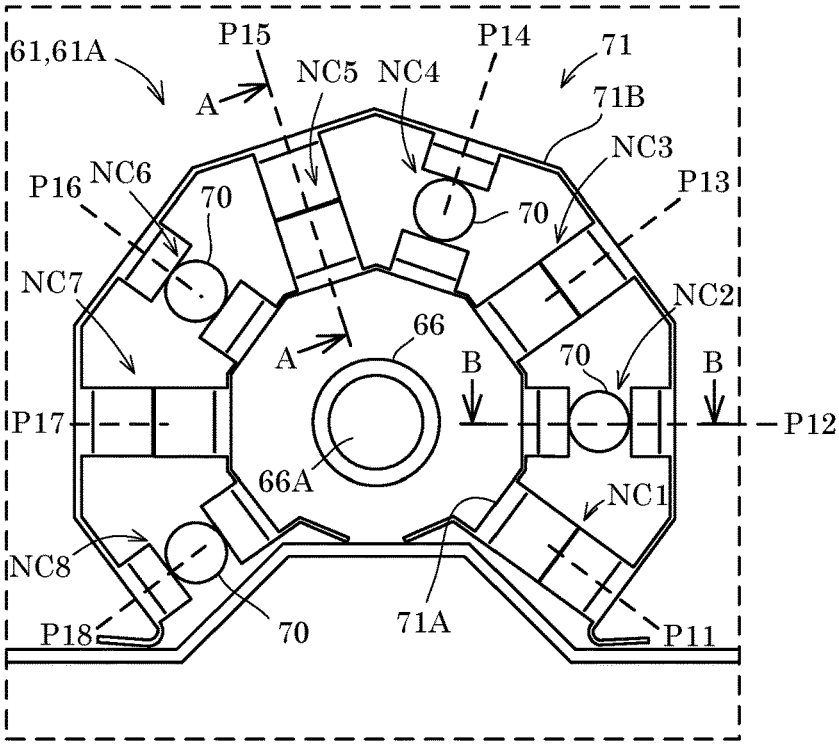
FIG. 10 is a front diagram showing a configuration of a coupled portion included in the image forming apparatus according to the embodiment of the present disclosure.
Figure 11:
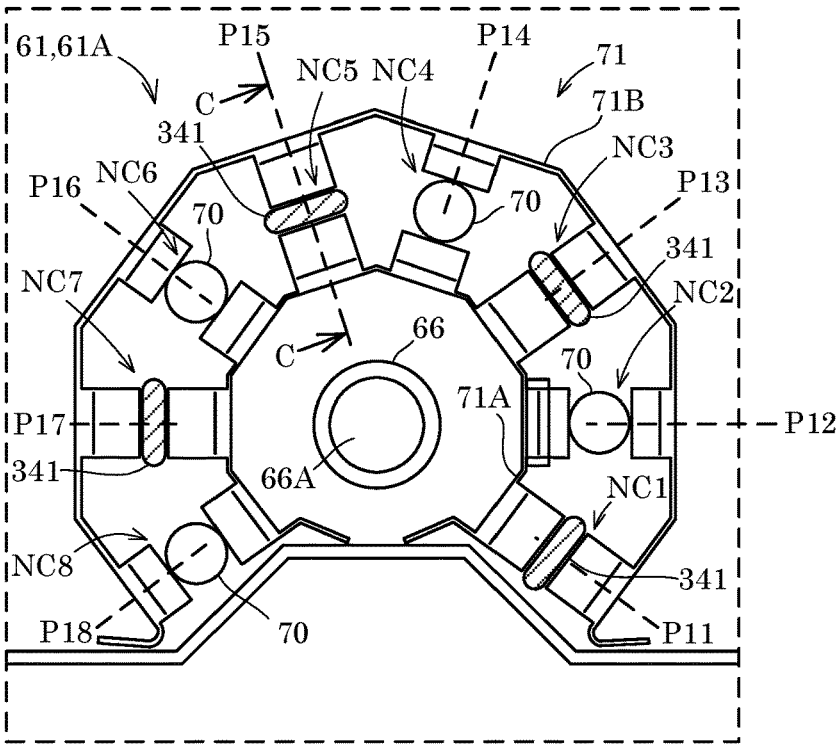
FIG. 11 is a front diagram showing a configuration of the coupled portion included in the image forming apparatus according to the embodiment of the present disclosure.

FIG. 10 is a schematic diagram showing the coupled portion 61A included in the coupling supporting portion 60. FIG. 11 is a diagram showing a state where the toner container 300A is coupled with the coupled portion 61A. The four coupled portions 61 (61A to 61D) are formed to have the same shape and configuration. As a result, in the following, the coupled portion 61A for black is described as a representative of the coupled portions 61 for the four colors. As shown in FIG. 10, the coupled portion 61A includes four interference keys 70, a contact terminal 71 (an example of detection electrodes of the present disclosure), and the protruding boss 66.

As shown in FIG. 10, the protruding boss 66 of a circular shape is provided at the center of the coupled portion 61A. The protruding boss 66 is a cylindrical member protruding from the attachment surface 63 toward the toner container 300A (frontward). A hole 66A is formed at the center of the front end surface of the protruding boss 66. The hole 66A is a portion into which the projection 342 for positioning is inserted, wherein the projection 342 is provided on the end surface 332A of the cover member 330.

The interference keys 70 are provided at any of the eight positions (P11 to P18) that are preliminarily set on the coupled portion 61A. The interference keys 70 are bar-like members projecting from the attachment surface 63 toward the toner container 300A (frontward). The interference keys 70 are made of an insulator that does not allow electricity to pass through it.

The positions P11 to P18 are defined on a circumference of a circle around the protruding boss 66. That is, as is the case with the positions P1 to P8, the positions P11 to P18 are set on the coupled portion 61A to form an arc shape along the circumference. In the present embodiment, the positions P11 to P18 are the same positions in each of the four coupled portion 61, and are defined on the circumference at an equal angle interval based on the center. In the example shown in FIG. 10, on the attachment surface 63, the position P11 is defined in correspondence with the position P1 on the end surface 332A of the cover member 330, and the positions P12 to P18 are defined at an equal angle interval from the position P11 in a CCW (counterclockwise) direction. As shown in FIG. 10, the positions P11 to P18 are arranged symmetrically with respect to a vertical line passing through the center of the protruding boss 66. When the toner container 300A is attached to the holding portion 51A, the position P1 faces the position P11, and the position P2 faces the position P12. In addition, the positions P3 to P8 face the positions P13 to P18, respectively.

In the present embodiment, on the coupled portion 61A, the four interference keys 70 are provided at positions where they do not interfere with the compatible keys 341, namely, at positions P12, P14, P16 and P18 among the positions P11 to P18. In other words, the four interference keys 70 are arranged to form an arc shape on the attachment surface 63 of the coupled portion 61A. With this configuration, when the toner container 300A having attachment compatibility for the coupled portion 61A is inserted in the holding portion 51A, the interference keys 70 do not hinder the attachment of the toner container 300A since the compatible keys 341 are disposed at the positions P11, P13, P15 and P17 at which no interference key 70 is provided, and the toner container 300A is attached to the holding portion 51A (see FIG. 11).

It is noted that if a toner container 300 that has a compatible key 341 at any one of the positions P2, P4, P6 and P8, is inserted in the holding portion 51A, the tip of the compatible key 341 abuts on any one of the interference keys 70. This prevents a further insertion of the toner container 300, and the attachment of the toner container 300 to the holding portion 51A is hindered. That is, such a toner container 300 does not have attachment compatibility with the holding portion 51A.

Meanwhile, there may be a case where when a toner container 300 having no attachment compatibility is inserted in the holding portion 51A, the toner container 300 reaches the attachment position. In addition, when the compatible keys 341 for realizing the incompatibility structure are lost due to breakage or the like, the toner container 300 can be inserted in a holding portion 51 for a color that is different from a color corresponding to the toner container 300. If the image forming operation is performed in such a state, unconformable toner may be supplied to the image forming portions 1 to 4, resulting in a defective printing. In view of this problem, the image forming apparatus 100 is configured to detect whether or not toner containers 300 having the attachment compatibility have been attached to the holding portions 51.

Figure 15:
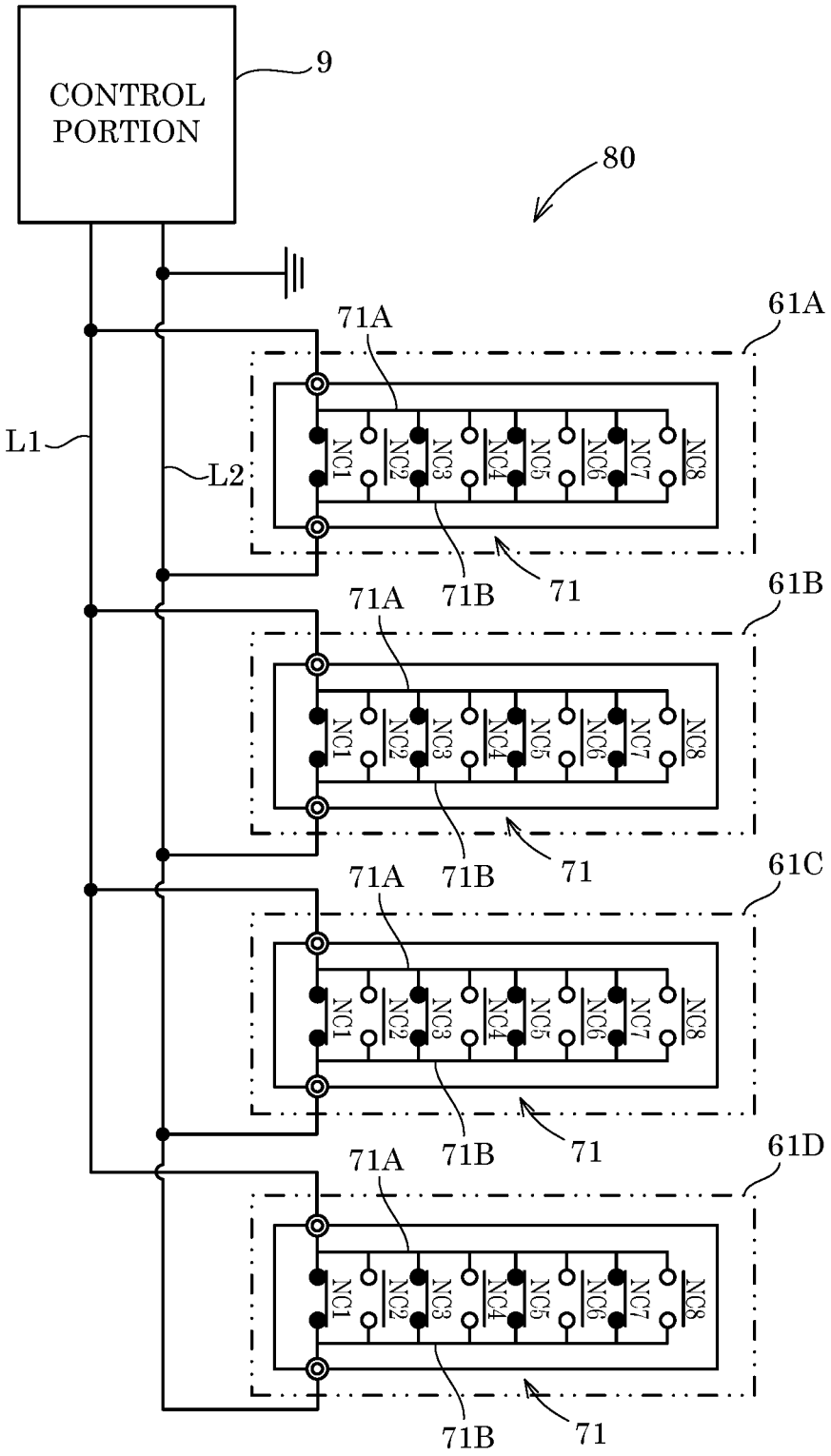
FIG. 15 is a diagram showing a configuration of a detection circuit included in the image forming apparatus according to the embodiment of the present disclosure.

Specifically, the image forming apparatus 100 includes a detection circuit 80 shown in FIG. 15. The detection circuit 80 is configured to detect whether or not toner containers 300 having the attachment compatibility are attached to all the holding portions 51. The detection circuit 80 includes a signal line L1, a ground line L2, and a plurality of contact terminals 71.

The contact terminals 71 are respectively provided on the coupled portions 61. Each contact terminal 71 is formed by processing a metal plate having conductivity. As shown in FIG. 10, each contact terminal 71 is composed of a pair of metal terminals 71A and 71B. The metal terminal 71A is disposed on the protruding boss 66 side on the coupled portion 61A, and is supported by a support piece (not shown) provided on the attachment surface 63. The metal terminal 71B is disposed outside the metal terminal 71A to face the metal terminal 71A, and is supported by a support piece (not shown) provided on the attachment surface 63.

Figure 12:
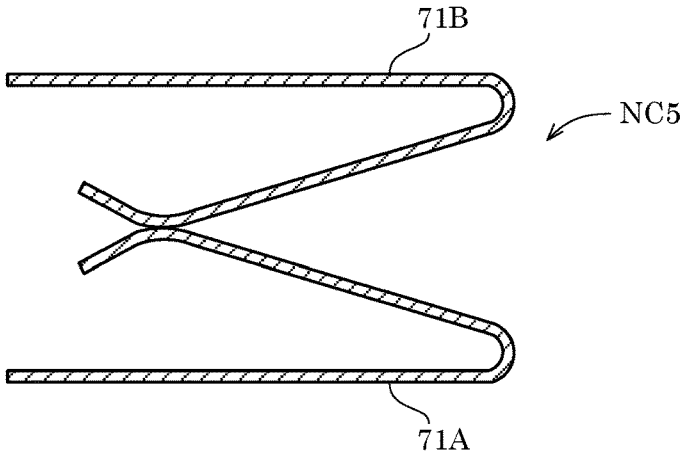
FIG. 12 is a diagram showing a configuration of a contact terminal included in the image forming apparatus according to the embodiment of the present disclosure.

Each contact terminal 71 includes eight contacts NC (NC1 to NC8) formed between the metal terminals 71A and 71B. At a normal time, each of the contacts NC is closed by a spring force generated by metal plates (see FIG. 12). FIG. 12 is a cross-sectional diagram taken along an A-A line and viewed from the direction of arrows indicated in FIG. 10, and shows the state of the contact NC5 at a normal time. As described below, the contact terminal 71 is configured to be opened upon receiving an external force in a direction of opening the contact NCs.

Figure 13:
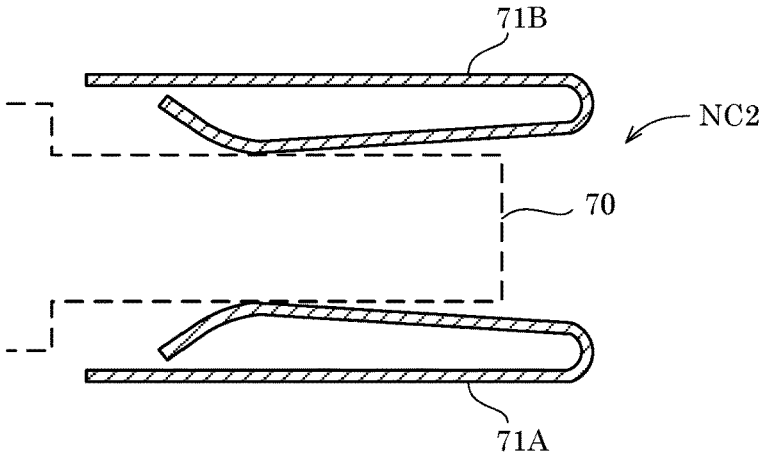
FIG. 13 is a diagram showing a configuration of the contact terminal included in the image forming apparatus according to the embodiment of the present disclosure.

In the contact terminal 71, the contacts NC1 to NC8 correspond to the positions P11 to P18, respectively. Specifically, the contact NC1 is disposed in correspondence with the position P11, and the contacts NC2 to NC8 are disposed at an equal angle interval from the position of the contact NC1 in a CCW (counterclockwise) direction. The contact terminal 71 is supported not only by the support pieces, but also by the interference keys 70 on the coupled portion 61A. Specifically, the contact NC2 is inserted around the interference key 70 at the position P12 (see FIG. 13). It is noted that FIG. 13 is a cross-sectional diagram taken along a B-B line and viewed from the direction of arrows indicated in FIG. 10, and shows a state where the contact NC2 is inserted around the interference key 70, and the contact NC2 is opened. In addition, the contact NC4 is inserted around the interference key 70 at the position P14, the contact NC6 is inserted around the interference key 70 at the position P16, and the contact NC8 is inserted around the interference key 70 at the position P18. In this way, when the contacts NC2, NC4, NC6 and NC8 are inserted around the interference keys 70, each of the contacts NC2, NC4, NC6, and NC8 holds the interference key 70 by a spring force in a closing direction.

Figure 14:
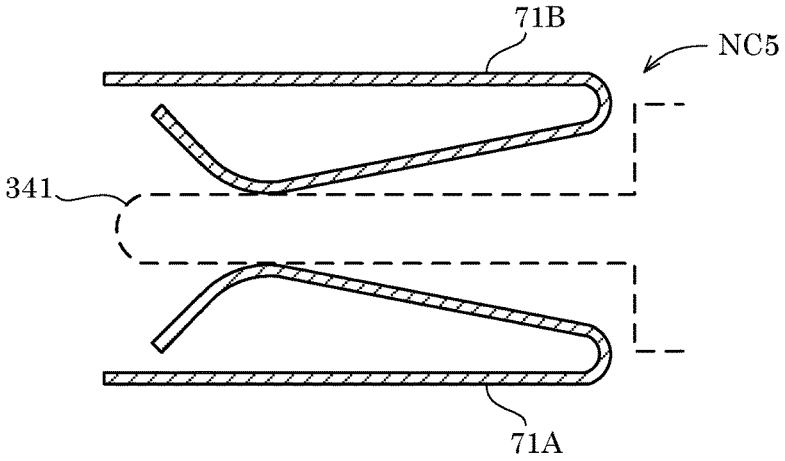
FIG. 14 is a diagram showing a configuration of the contact terminal included in the image forming apparatus according to the embodiment of the present disclosure.

In a state where the contact terminal 71 has been attached to the coupled portion 61A, when the toner container 300A is inserted in the holding portion 51A, the tips of the compatible keys 341 abut on corresponding contacts NC of the contact terminal 71 before the toner container 300A reaches the attachment position. When the toner container 300A is further inserted into the holding portion 51A, the tips of the compatible keys 341 enter and open the contacts NC. Specifically, when the toner container 300A is attached to the holding portion 51A, four compatible keys 341 enter and open the contacts NC1, NC3, NC5 and NC7 (see FIG. 14). It is noted that FIG. 14 is a cross-sectional diagram taken along a C-C line and viewed from the direction of arrows indicated in FIG. 11, and shows a state where the compatible key 341 has entered and opened the contact NC5.

In the detection circuit 80, the four contact terminals 71 respectively provided on the four coupled portions 61, are connected in parallel by the signal line L1 and the ground line L2. Specifically, as shown in FIG. 15, the metal terminals 71A of the contact terminals 71 are connected with each other by a common signal line L1. In addition, the metal terminals 71B of the contact terminals 71 are connected with each other by a common ground line L2. The signal line L1 is connected to the control portion 9. In addition, the ground line L2 is connected to the control portion 9 in a state of being grounded to have a reference potential (for example, the earth potential). The control portion 9 applies voltage of a predetermined voltage value to the signal line L1. The control portion 9 measures the voltage between the signal line L1 and the ground line L2, and determines whether or not the signal line L1 and the ground line L2 are conducted to each other depending on whether or not the measured value is the reference potential.

With the above-described configuration of the coupled portion 61, in the present embodiment, when no toner container 300 has been attached to the holding portions 51, the contacts NC are in a state shown in FIG. 15, namely, part of the contacts NC are closed to be in the ON state, allowing the control portion 9 to determine that the signal line L1 and the ground line L2 are conducted to each other. In this case, the control portion 9 determines that the apparatus is not in a state where the toner containers 300 having the attachment compatibility are attached to all the holding portions 51.

Figure 16:
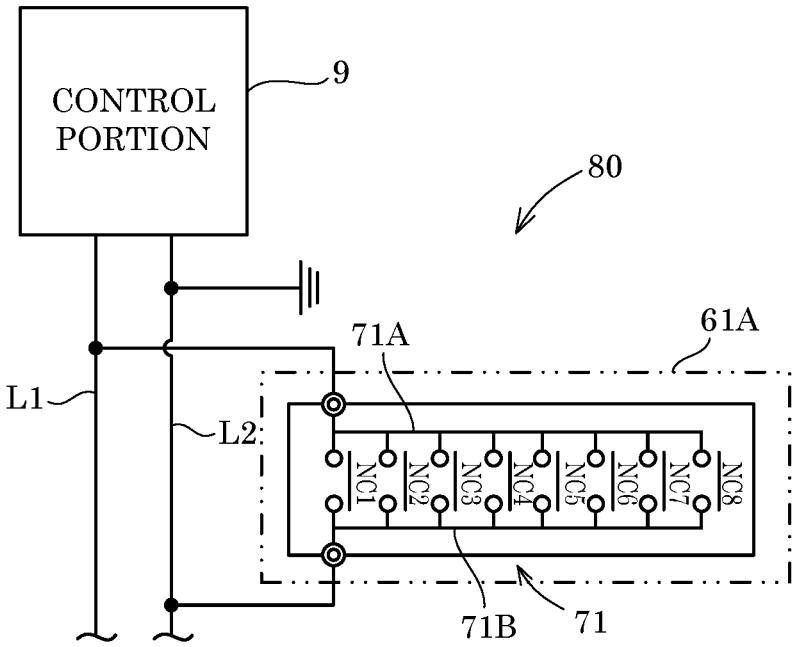
FIG. 16 is a diagram showing an operation example of the detection circuit included in the image forming apparatus according to the embodiment of the present disclosure.

In addition, in a case where the toner containers 300 having the attachment compatibility are attached to all of the four holding portions 51, all the contacts NC are opened to be in the OFF state as shown in FIG. 16. When all the contacts NC are in the OFF state, the control portion 9 determines that the signal line L1 and the ground line L2 are not conducted to each other. In this case, the control portion 9 determines that the apparatus is in a state where the toner containers 300 having the attachment compatibility are attached to all the holding portions 51. It is noted that FIG. 16 shows a state of the contact terminal 71 of the coupled portion 61A, and omits the states of the other contact terminals 71.

Figure 17:
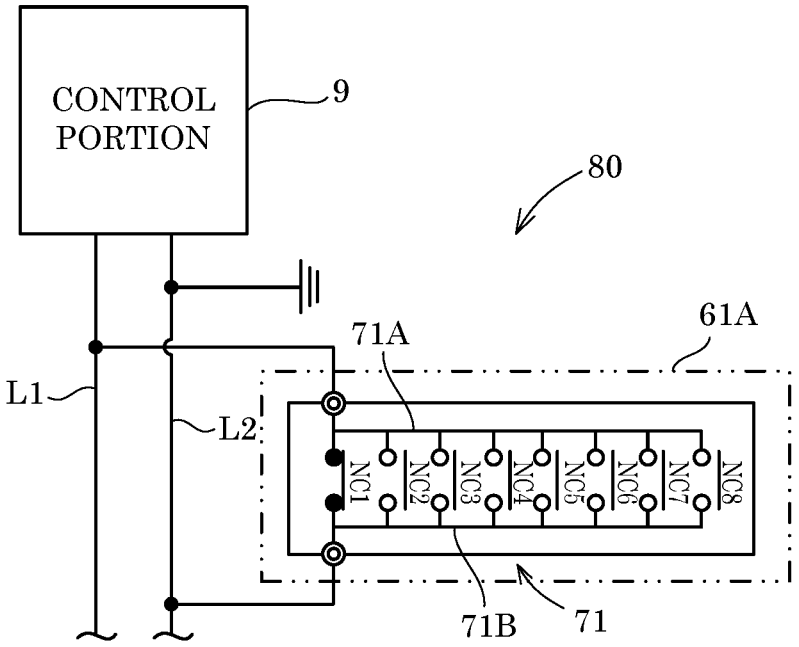
FIG. 17 is a diagram showing an operation example of the detection circuit included in the image forming apparatus according to the embodiment of the present disclosure.

When an unconformable toner container 300 is attached to the holding portion 51A among the four holding portions 51, part of the contacts NC of the contact terminal 71 of the coupled portion 61A are closed to be in the ON state. For example, as shown in FIG. 17, when a toner container 300 lacking a compatible key 341 at the position P1 is attached to the holding portion 51A, only the contact NC1 is in the ON state, and the other contacts NC are opened to be in the OFF state. In this case, since the contact NC1 is in the ON state, the signal line L1 and the ground line L2 are conducted to each other. In this case, the control portion 9 determines that the apparatus is not in the state where the toner containers 300 having the attachment compatibility are attached to all the holding portions 51.

In the image forming apparatus 100, when the control portion 9 determines that the apparatus is in the state where the toner containers 300 having the attachment compatibility are attached to all the holding portions 51, detachments of the toner containers 300 are regulated by the lock mechanisms 41. Thereafter, when a toner shortage is detected with respect to any one of the toner containers 300, the regulation of the detachment of only the toner container 300 whose toner shortage has been detected by the lock mechanism 41 is released. This makes it possible to restrict a replacement of each toner container 300 before a toner shortage is detected.

On the other hand, in the image forming apparatus 100, when the control portion 9 determines that the apparatus is not in the state where the toner containers 300 having the attachment compatibility are attached to all the holding portions 51, execution of the print process is restricted. In addition, in this case, it is notified that there is a holding portion 51 to which a toner container 300 having the attachment compatibility has not been attached. This makes it possible to urge the user to replace the toner container 300, while restricting the execution of the print process that uses unconformable toner.

Meanwhile, in the image forming apparatus 100, the attachment state of a toner container 300 attached to a holding portion 51 may become unstable due to deterioration over time or the like, and thereby the toner container 300 may move toward the upstream in the insertion direction D21. For example, either or both of; the engaging portions 336 of the toner container 300; and the engaged portions 69 of the coupling supporting portion 60 may be deformed due to deterioration over time or temperature change, and thereby the regulation of the movement of the toner container 300 that is imposed by the engagement of the engaging portions 336 and the engaged portions 69, may be loosened. In that case, when an impact is applied to the housing 13 of the image forming apparatus 100 from outside, a toner container(s) 300 may be displaced from the attachment position due to the impact. In that case, the compatible keys 341 may be released from the contact terminals 71, and it may be erroneously detected that a toner container 300 not having the attachment compatibility is attached, although in the actuality, the toner containers 300 having the attachment compatibility are attached to all the holding portions 51. The state where such erroneous detection may occur will be dissolved when the toner container 300 whose compatible keys 341 have been released from the contact terminals 71 is correctly attached again.

Here, when the detachment of the toner containers 300 has been regulated by the lock mechanisms 41, it is necessary to release the detachment regulation of a lock mechanism 41 that corresponds to the toner container 300 whose compatible keys 341 have been released from the contact terminals 71. In addition, when the detection circuit 80 has been provided, it is necessary to release the detachment regulation of all the lock mechanisms 41 since the toner container 300 whose compatible keys 341 have been released from the contact terminals 71, cannot be identified. However, if the detachment regulation of all the lock mechanisms 41 is released each time an attachment of a toner container 300 not having the attachment compatibility is detected, it is possible for the user to replace a toner container 300 before a toner shortage is detected, by intentionally causing the apparatus to detect an attachment of a toner container 300 not having the attachment compatibility. Specifically, the user can intentionally cause the image forming apparatus 100 to detect an attachment of a toner container 300 not having the attachment compatibility, by causing the image forming apparatus 100 to perform the detection process using the detection circuit 80 in a state where a toner container 300 has been detached from the holding portion 51.

On the other hand, as described in the following, according to the image forming apparatus 100 of the present embodiment, it is possible to deal with an erroneous detection of a type of toner container 300 while restricting replacement of a toner container 300 before a toner shortage is detected.

Specifically, the ROM of the control portion 9 stores, in advance, a detachment regulation control program that causes the CPU to execute a first release process (see the flowchart of FIG. 19), a second release process (see the flowchart of FIG. 20), and a print restriction process (see the flowchart of FIG. 21) that are described below. It is noted that the detachment regulation control program may be recorded on a computer-readable recording medium such as a CD, a DVD, or a flash memory, and may be read from the recording medium to be installed in a storage device such as the EEPROM of the control portion 9.

Figure 18:
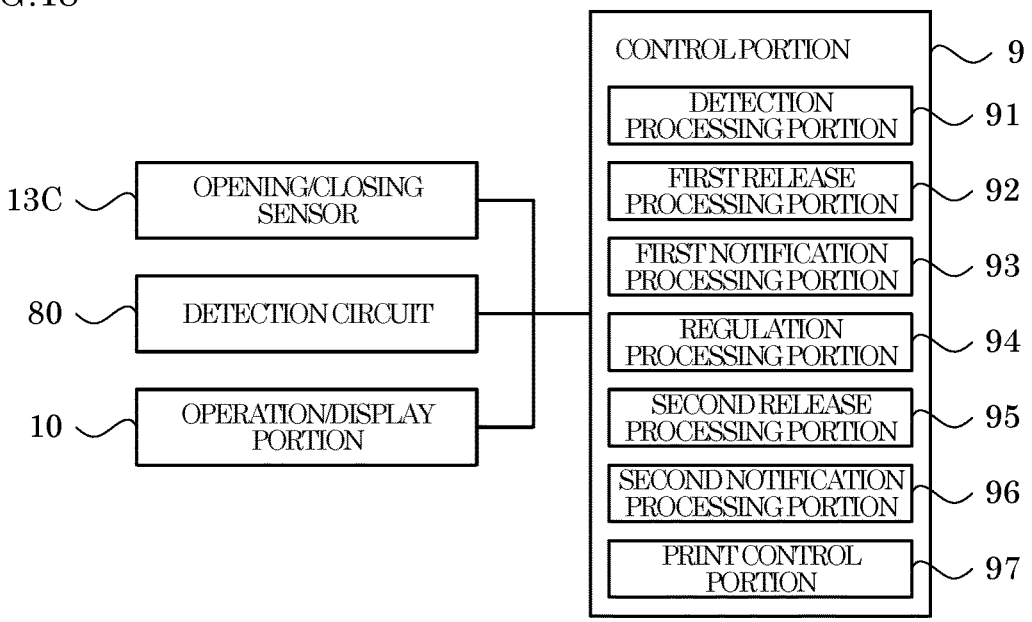
FIG. 18 is a block diagram showing a system configuration of the image forming apparatus according to the embodiment of the present disclosure.

As shown in FIG. 18, the control portion 9 includes a detection processing portion 91, a first release processing portion 92, a first notification processing portion 93, a regulation processing portion 94, a second release processing portion 95, a second notification processing portion 96, and a print control portion 97. Specifically, the control portion 9 executes the detachment regulation control program stored in the ROM by using the CPU. This allows the control portion 9 to function as the detection processing portion 91, the first release processing portion 92, the first notification processing portion 93, the regulation processing portion 94, the second release processing portion 95, the second notification processing portion 96, and the print control portion 97.

The detection processing portion 91 is configured to detect, for each of the holding portions 51, whether or not the holding portion 51 is in a specific state where a remaining amount of toner stored in a toner container 300 attached to the holding portion 51 is smaller than a predetermined lower-limit amount.

For example, the detection processing portion 91 obtains remaining amounts of toner in the developing devices 23 by using toner sensors (not shown) provided in the developing devices 23. Thereafter, the detection processing portion 91 detects, for each of the holding portions 51, whether or not the holding portion 51 is in the specific state, based on the obtained remaining amounts of toner. For example, in a case where the toner is supplied from the toner container 300 to the developing device 23 during execution of the print process, the detection processing portion 91 detects whether or not the holding portion 51 is in the specific state, based on the speed at which increases the remaining amount of toner in the developing device 23 obtained by the toner sensor.

It is noted that the detection processing portion 91 may detect whether or not the holding portion 51 is in the specific state, by calculating the consumption amount of toner based on the printing rate of image data printed in the print process, and comparing a cumulative value of the calculated consumption amount of toner, with the toner capacity of the toner container 300. In addition, the detection processing portion 91 may detect whether or not the holding portion 51 is in the specific state, by calculating the amount of toner conveyed from the toner container 300 based on the driving time of the drive source that rotates the gear 68, and comparing a cumulative value of the calculated amount of conveyed toner, with the toner capacity of the toner container 300.

When the detection processing portion 91 detects a holding portion 51 that is in the specific state, the first release processing portion 92 causes a lock mechanism 41 corresponding to the holding portion 51 in the specific state, to release the regulation of the detachment of the toner container 300.

For example, when the detection processing portion 91 detects a holding portion 51 that is in the specific state, the first release processing portion 92 causes a power source (not shown) to supply power to the solenoid 414A. This allows the restriction member 412 in the lock mechanism 41A to be moved from the lock position to the release position, thereby releasing the lock of the lock cover 411.

It is noted that when a predetermined abnormality is detected, the first release processing portion 92 may cause a lock mechanism(s) 41 corresponding to a part or all of the holding portions 51 to release the regulation of the detachment of the toner container 300.

When the detection processing portion 91 detects that any one of the holding portions 51 is in the specific state, the first notification processing portion 93 notifies that a toner shortage has been detected in a toner container 300. For example, the first notification processing portion 93 displays, on the operation/display portion 10, information identifying a toner container 300 in which the toner shortage has been detected, and a first message indicating that a toner shortage has been detected in the toner container 300.

When the detection circuit 80 has detected a first state where the toner containers 300 having the attachment compatibility are attached to all the holding portions 51, and there is a lock mechanism 41 that is not regulating the detachment of a toner container 300, the regulation processing portion 94 is configured to cause the lock mechanism 41 to regulate the detachment of the toner container 300.

For example, when a predetermined detection timing comes, the regulation processing portion 94 determines whether or not there is a lock mechanism 41 that is not regulating the detachment of a toner container 300. For example, the detection timing is when the image forming apparatus 100 has been powered on, or when the opening/closing sensor 13C has detected closing of the front cover 13A.

For example, in the image forming apparatus 100, the state of the detachment regulation of each of the lock mechanisms 41 is recorded on the EEPROM. For example, regulation state information indicating the state of the detachment regulation of each lock mechanism 41 is stored in the EEPROM. The regulation state information is updated by the control portion 9 each time the state of the detachment regulation of a part or all of the lock mechanisms 41 changes. The regulation processing portion 94 determines, based on the regulation state information, whether or not there is a lock mechanism 41 that is not regulating the detachment of a toner container 300.

Upon determining that there is a lock mechanism 41 that is not regulating the detachment of a toner container 300, the regulation processing portion 94 determines whether or not the detection circuit 80 has detected the first state.

Specifically, in a case where the detection circuit 80 is not conducted, the regulation processing portion 94 determines that the detection circuit 80 has detected the first state. On the other hand, in a case where the detection circuit 80 is conducted, the regulation processing portion 94 determines that the detection circuit 80 has detected a second state where there is at least one holding portion 51 to which a toner container 300 having the attachment compatibility has not been attached.

Upon determining that the detection circuit 80 has detected the first state, the regulation processing portion 94 causes the lock mechanism 41 that is not regulating the detachment of a toner container 300, to regulate the detachment of the toner container 300. For example, to cause the lock mechanism 41A to regulate the detachment of the toner container 300, the regulation processing portion 94 causes a power source (not shown) to stop supplying power to the solenoid 414A. This allows, the restriction member 412 in the lock mechanism 41A to be moved from the release position to the lock position, and the lock cover 411 is restricted from being opened.

It is noted that upon determining that the detection circuit 80 has detected the first state, the regulation processing portion 94 may determine whether or not the specific state has been detected in a holding portion 51 that corresponds to a lock mechanism 41 that is not regulating the detachment of a toner container 300. Furthermore, upon determining that the specific state has been detected in a holding portion 51 that corresponds to a lock mechanism 41 that is not regulating the detachment of a toner container 300, the regulation processing portion 94 may suspend causing the lock mechanism 41 to regulate the detachment until the specific state is dissolved.

When the detection circuit 80 has detected the second state, and all the lock mechanisms 41 are regulating the detachment of the toner containers 300, the second release processing portion 95 causes all the lock mechanisms 41 to release the regulation of the detachment of the toner containers 300.

For example, when the regulation processing portion 94 determines that there is no lock mechanism 41 that is not regulating the detachment of a toner container 300, the second release processing portion 95 determines whether or not the detection circuit 80 has detected the second state.

Specifically, as is the case with the regulation processing portion 94, in a case where the detection circuit 80 is not conducted, the second release processing portion 95 determines that the detection circuit 80 has detected the first state. On the other hand, in a case where the detection circuit 80 is conducted, the second release processing portion 95 determines that the detection circuit 80 has detected the second state.

In a case where the detection circuit 80 has detected the second state, and all the lock mechanisms 41 are regulating the detachment of the toner containers 300, the second notification processing portion 96 (an example of a notification processing portion of the present disclosure) notifies that an attachment failure has occurred in any of the holding portions 51. For example, the second notification processing portion 96 displays, on the operation/display portion 10, a second message that states that an attachment failure has occurred in any of the holding portions 51, and urges to re-attach each of the toner containers 300.

On the other hand, when the detection circuit 80 has detected the second state, and there is a lock mechanism 41 that is not regulating the detachment of a toner container 300, the second notification processing portion 96 notifies that there is a holding portion 51 to which a toner container 300 having the attachment compatibility has not been attached. For example, the second notification processing portion 96 displays, on the operation/display portion 10, a third message that indicates that there is a holding portion 51 to which a toner container 300 having the attachment compatibility has not been attached.

It is noted that the control portion 9 may not include the second notification processing portion 96.

In a case where the detection circuit 80 has detected the second state and a predetermined permission period has elapsed, the print control portion 97 restricts the execution of the print process until the detection circuit 80 detects the first state, wherein the permission period extends from a time when the second release processing portion 95 released the regulation of the detachment of the toner containers 300 the most lately to a time when a predetermined end condition is satisfied. For example, the print control portion 97 prohibits the execution of the print process until the detection circuit 80 detects the first state. Alternatively, the print control portion 97 may decrease the print speed in the print process until the detection circuit 80 detects the first state.

For example, the end condition is that the cumulative number of output prints that have been output since the latest release of the regulation of the detachment of the toner containers 300 by the second release processing portion 95, reaches a predetermined number. It is noted that the end condition may be that the cumulative number of times that the print job has been executed since the latest release of the regulation of the detachment of the toner containers 300 by the second release processing portion 95, reaches a predetermined number. Furthermore, the end condition may be that an elapsed time since the latest release of the regulation of the detachment of the toner containers 300 by the second release processing portion 95 exceeds a predetermined time.

It is noted that the control portion 9 may not include the print control portion 97.

[First Release Process]

Figure 19:
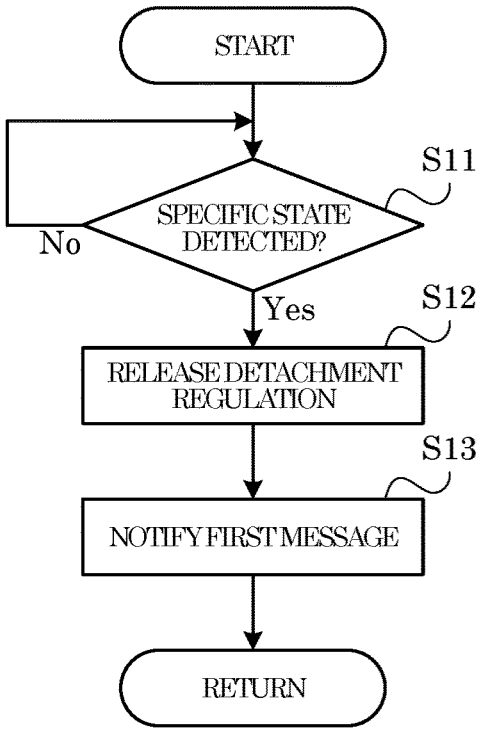
FIG. 19 is a flowchart showing an example of a first release process executed by the image forming apparatus according to the embodiment of the present disclosure.

In the following, with reference to FIG. 19, a description is given of an example of the procedure of the first release process executed by the control portion 9 in the image forming apparatus 100. Here, steps S11, S12, . . . represent numbers assigned to the processing procedures (steps) executed by the control portion 9.

<Step S11>

First, in step S11, the control portion 9 determines whether or not any of the holding portions 51 is in the specific state. Here, the process of step S11 is executed by the detection processing portion 91 of the control portion 9.

Upon determining that any of the holding portions 51 is in the specific state (Yes side at S11), the control portion 9 moves the process to step S12. In addition, upon determining that none of the holding portions 51 is in the specific state (No side at S11), the control portion 9 waits at step S11 until it detects that any of the holding portions 51 is in the specific state.

<Step S12>

In step S12, the control portion 9 causes a lock mechanism 41 corresponding to the holding portion 51 detected to be in the specific state, to release the regulation of the detachment of a toner container 300. Here, the process of step S12 is executed by the first release processing portion 92 of the control portion 9.

<Step S13>

In step S13, the control portion 9 notifies that a toner shortage has been detected in any of the toner containers 300. For example, the control portion 9 displays, on the operation/display portion 10, information identifying a toner container 300 in which the toner shortage has been detected, as well as the first message. Here, the process of step S13 is executed by the first notification processing portion 93 of the control portion 9.

[Second Release Process]

Figure 20:
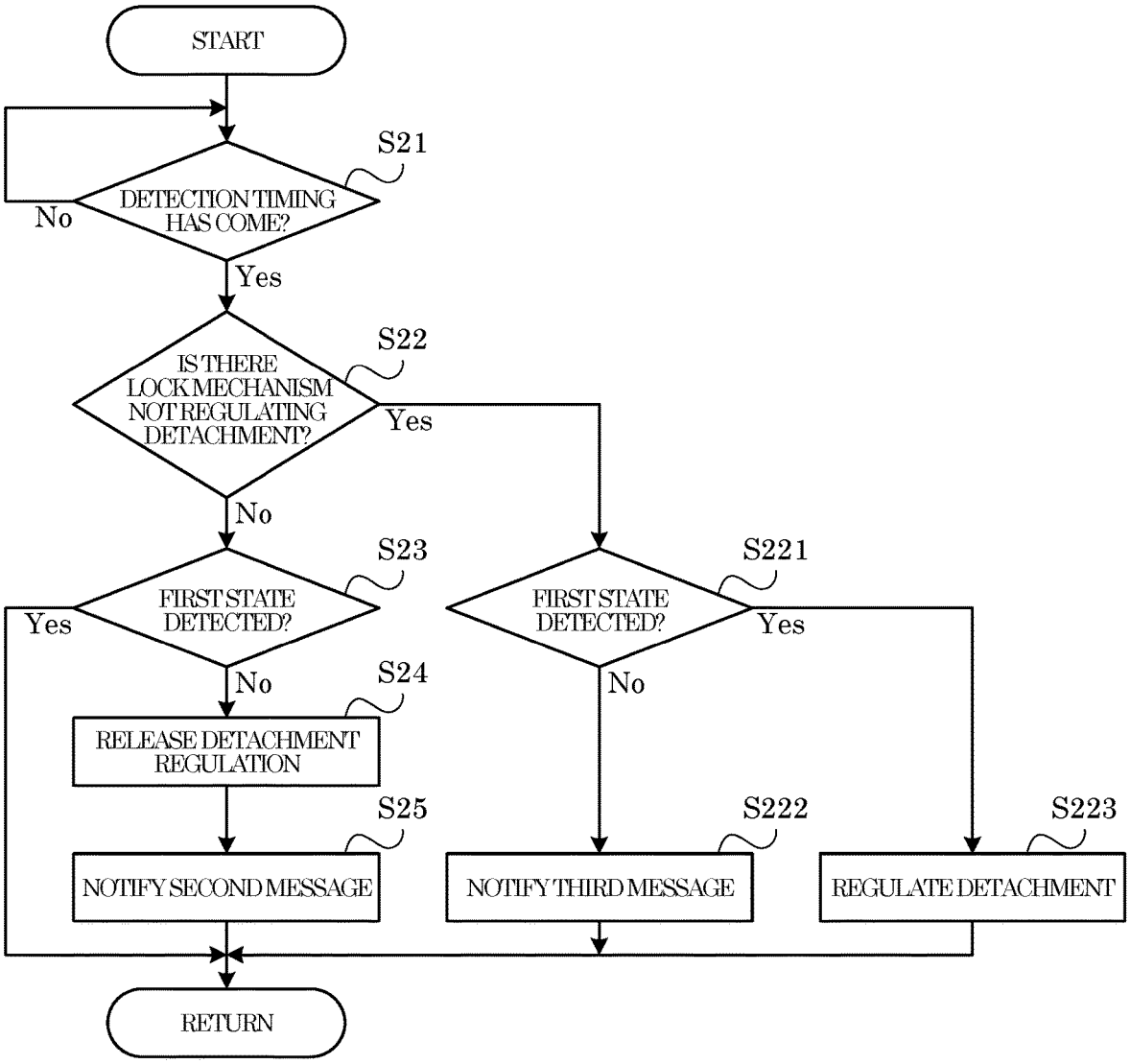
FIG. 20 is a flowchart showing an example of a second release process executed by the image forming apparatus according to the embodiment of the present disclosure.

Next, with reference to FIG. 20, a description is given of an example of the procedure of the second release process executed by the control portion 9 in the image forming apparatus 100.

<Step S21>

First, in step S21, the control portion 9 determines whether or not the detection timing has come.

For example, after the lock mechanism 41 releases the regulation of the detachment of the toner container 300 in the first release process, the user opens the front cover 13A and replaces the toner container 300A attached to the holding portion 51A with a new one. Subsequently, when the front cover 13A is closed by the user and the closing of the front cover 13A is detected by the opening/closing sensor 13C, the control portion 9 determines that the detection timing has come.

In addition, when the image forming apparatus 100 is powered on, the control portion 9 determines that the detection timing has come.

Here, upon determining that the detection timing has come (Yes side at S21), the control portion 9 moves the process to step S22. In addition, upon determining that the detection timing has not come (No side at S21), the control portion 9 waits at step S21 for the detection timing to come.

<Step S22>

In step S22, the control portion 9 determines whether or not there is a lock mechanism 41 that is not regulating the detachment of a toner container 300.

In a case where step S22 is executed in response to a closing of the front cover 13A after replacement of a toner container 300, at the starting point of step S22, a lock mechanism 41 corresponding to a holding portion 51 to which a new toner container 300 has been attached, is not regulating the detachment of the toner container 300. Accordingly, in this case, based on the regulation state information, the control portion 9 determines that there is a lock mechanism 41 that is not regulating the detachment of a toner container 300.

In addition, in a case where step S22 is executed in response to a power-on of the image forming apparatus 100 after execution of the process of step S223 that is described below, all the lock mechanisms are regulating the detachment of the toner containers 300. Accordingly, in this case, based on the regulation state information, the control portion 9 determines that there is no lock mechanism 41 that is not regulating the detachment of a toner container 300.

Here, upon determining that there is a lock mechanism 41 that is not regulating the detachment of a toner container 300 (Yes side at S22), the control portion 9 moves the process to step S221. In addition, upon determining that there is no lock mechanism 41 that is not regulating the detachment of a toner container 300 (No side at S22), the control portion 9 moves the process to step S23.

<Step S221>

In step S221, the control portion 9 determines whether or not the detection circuit 80 has detected the first state.

For example, in a case where step S221 is executed in response to a closing of the front cover 13A after replacement of a toner container 300 with a new toner container 300 that has the attachment compatibility, the control portion 9 determines that the detection circuit 80 has detected the first state. On the other hand, when the new toner container 300 does not have the attachment compatibility, or when a toner container 300 has not been attached, the control portion 9 determines that the detection circuit 80 has not detected the first state.

Here, upon determining that the detection circuit 80 has detected the first state (Yes side at S221), the control portion 9 moves the process to step S223. In addition, upon determining that the detection circuit 80 has not detected the first state (No side at S221), the control portion 9 moves the process to step S222.

<Step S222>

In step S222, the control portion 9 notifies that there is a holding portion 51 to which a toner container 300 having the attachment compatibility has not been attached. For example, the control portion 9 displays the third message on the operation/display portion 10. Here, the process of step S222 is executed by the second notification processing portion 96 of the control portion 9.

<Step S223>

In step S223, the control portion 9 causes the lock mechanism 41 that is not regulating the detachment of a toner container 300, to regulate the detachment of the toner container 300. Here, the processes of steps S21, S22, S221, and S223 are executed by the regulation processing portion 94 of the control portion 9.

As described above, in the second release process, after it is confirmed that the toner containers 300 having the attachment compatibility are attached to all the holding portions 51, the detachment regulation is executed by the lock mechanisms 41. As a result, when it is determined that all the lock mechanisms 41 are regulating the detachment of the toner containers 300 (No side at S22), all the toner containers 300 stored in the holding portions 51 are expected to have the attachment compatibility. As a result, when, in these circumstances, the second state is detected by the detection circuit 80, it is possible to determine that this is because there is an attachment failure in any of the holding portions 51.

<Step S23>

In step S23, the control portion 9 determines whether or not the detection circuit 80 has detected the first state.

Here, upon determining that the detection circuit 80 has detected the first state (Yes side at S23), the control portion 9 moves the process to step S21. In addition, upon determining that the detection circuit 80 has not detected the first state (No side at S23), the control portion 9 moves the process to step S24.

<Step S24>

In step S24, the control portion 9 causes all the lock mechanisms 41 to release the regulation of the detachment of the toner containers 300. Here, the processes of steps S23 and S24 are executed by the second release processing portion 95 of the control portion 9.

<Step S25>

In step S25, the control portion 9 notifies that an attachment failure has occurred in any of the holding portions 51. For example, the control portion 9 displays the second message on the operation/display portion 10. Here, the process of step S25 is executed by the second notification processing portion 96 of the control portion 9.

[Print Restriction Process]

Figure 21:
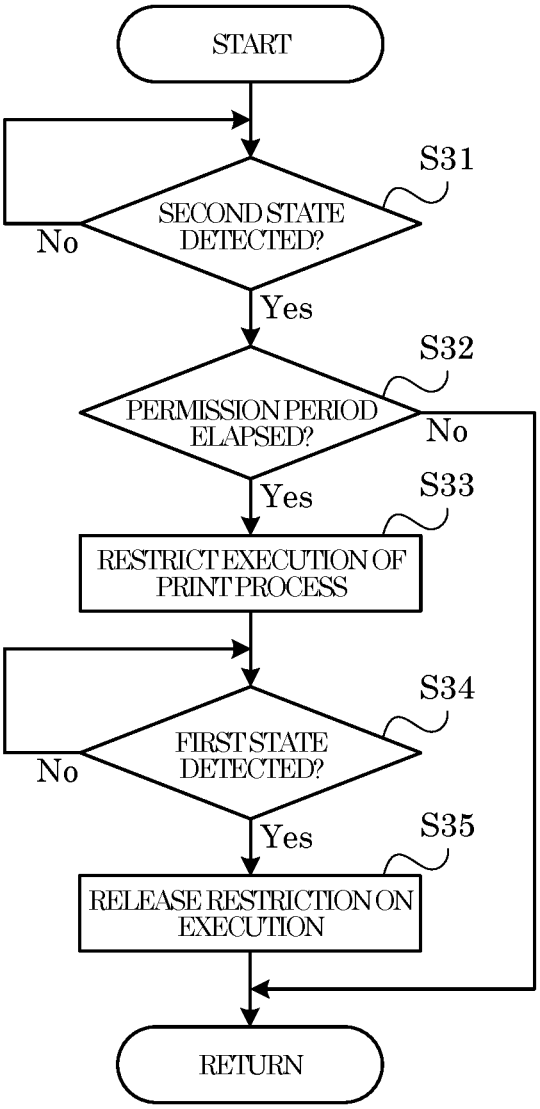
FIG. 21 is a flowchart showing an example of a print restriction process executed by the image forming apparatus according to the embodiment of the present disclosure.

Next, with reference to FIG. 21, a description is given of an example of the procedure of the print restriction process executed by the control portion 9 in the image forming apparatus 100. Here, the print restriction process is executed by the print control portion 97 of the control portion 9.

<Step S31>

First, in step S31, the control portion 9 determines whether or not the detection circuit 80 has detected the second state.

Here, upon determining that the detection circuit 80 has detected the second state (Yes side at S31), the control portion 9 moves the process to step S32. In addition, upon determining that the detection circuit 80 has not detected the second state (No side at S31), the control portion 9 waits at step S31 for the detection circuit 80 to detect the second state.

<Step S32>

In step S32, the control portion 9 determines whether or not the permission period that extends from the latest execution of step S24 in the second release process to a time when the end condition is satisfied, has elapsed.

Here, upon determining that the permission period has elapsed (Yes side at S32), the control portion 9 moves the process to step S33. In addition, upon determining that the permission period has not elapsed (No side at S32), the control portion 9 moves the process to step S31.

With the above-described configuration, when an attachment failure occurs in any holding portion 51, and the attachment failure is not dissolved even if the user reattaches the toner container 300, it is possible to avoid restricting an execution of the print process until the permission period elapses. As a result, when it is erroneously detected that a toner container 300 not having the attachment compatibility has been attached, it is possible to permit printing to a certain extent while prohibiting the use of toner that is unconformable to the image forming apparatus 100.

<Step S33>

In step S33, the control portion 9 restricts the execution of the print process. For example, the control portion 9 prohibits the execution of the print process.

<Step S34>

In step S34, the control portion 9 determines whether or not the detection circuit 80 has detected the first state.

Here, upon determining that the detection circuit 80 has detected the first state (Yes side at S34), the control portion 9 moves the process to step S35. In addition, upon determining that the detection circuit 80 has not detected the first state (No side at S34), the control portion 9 waits at step S34 for the detection circuit 80 to detect the first state.

<Step S35>

In step S35, the control portion 9 releases the restriction on the execution of the print process, the restriction having been imposed in step S33.

As described above, in the image forming apparatus 100, in a case where the detection circuit 80 has detected the first state and there is a lock mechanism 41 that is not regulating the detachment of a toner container 300, the lock mechanism 41 is caused to regulate the detachment of the toner container 300. In addition, in the image forming apparatus 100, when the detection circuit 80 has detected the second state when all the lock mechanisms 41 are regulating the detachment of the toner containers 300, all the lock mechanisms 41 are caused to release the regulation of the detachment of the toner containers 300. This allows all the lock mechanisms 41 to release the regulation of the detachment of the toner containers 300 only when it is erroneously detected that a toner container 300 not having the attachment compatibility has been attached. As a result, it is possible to deal with an erroneous detection of a type of toner container 300 while restricting replacement of a toner container 300 before a toner shortage is detected.

[Modifications]

According to the above-described embodiment, the compatible keys 341 have insulation. However, not limited to this, the compatible keys 341 may be conductive. In this case, parts of the contact terminals 71 that come in contact with the compatible keys 341 may be separated from each other in a state where the compatible keys 341 are not inserted therein, and when the toner container 300 is attached to the holding portion 51 and the compatible keys 341 are inserted therein, the parts of the contact terminals 71 come in contact with the compatible keys 341 and the contact terminals 71 are electrically connected with each other via the compatible keys 341. In addition, in the detection circuit 80, the four contact terminals 71 may be connected in series. Furthermore, in a case where the detection circuit 80 is conducted, the regulation processing portion 94 and the second release processing portion 95 may determine that the detection circuit 80 has detected the first state; and in a case where the detection circuit 80 is not conducted, they may determine that the detection circuit 80 has detected the second state.

In the above-described embodiment, the compatible keys 341 function as the protruding portion of the present disclosure. However, not limited to this configuration, instead of the compatible keys 341, a member that functions as the protruding portion of the present disclosure may be provided in the toner container 300. For example, the toner container 300 may include a conductive or insulating protruding portion that protrudes from the circumferential surface of the cover member 330 in a direction perpendicular to the insertion direction D21. In this configuration, a groove extending along the insertion direction D21 may be formed in the opening portion 311 and the holding portion 51 such that the protruding portion can move therein. In addition, the contact terminals 71 may be disposed such that the protruding portion is inserted between the contact terminals 71 when the toner container 300 is attached to the holding portion 51.

In the above-described embodiment, the toner container 300 includes four compatible keys 341, and the coupled portion 61 includes four interference keys 70. However, the number and the positions of the compatible keys 341 and the interference keys 70 are not limited to the above-mentioned ones.

In the above-described embodiment, the coupling portion 340 is included in the cover member 330. However, the coupling portion 340 may be formed integrally with the container main body 310 of the toner container 300 as far as the toner container 300 does not include the cover member 330.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a plurality of attachment portions to each of which a developer storage portion storing developer used for printing is attached;

a plurality of lock mechanisms respectively provided in correspondence with the plurality of attachment portions and each configured to regulate detachment of a developer storage portion attached to a corresponding one of the attachment portions;

a detection processing portion configured to detect whether or not any one of the plurality of attachment portions is in a specific state where a remaining amount of toner stored in a developer storage portion attached to the attachment portion is smaller than a predetermined lower-limit amount;

a first release processing portion configured to, when the detection processing portion has detected that one of the plurality of attachment portions is in the specific state, cause a lock mechanism corresponding to the attachment portion detected to be in the specific state, to release regulation of detachment of the developer storage portion attached to the attachment portion in the specific state;

a plurality of detection electrodes respectively provided in correspondence with the plurality of attachment portions and each configured to switch its status between being conducted and being not conducted when a developer storage portion of a predetermined specific type is attached to a corresponding attachment portion;

a detection circuit in which all of the plurality of detection electrodes are connected in series or in parallel and which is configured to detect whether or not developer storage portions of the specific type are attached to all of the plurality of attachment portions;

a regulation processing portion configured to, when the detection circuit has detected a first state where developer storage portions of the specific type are attached to all of the plurality of attachment portions, and there is a lock mechanism that is not regulating detachment of a developer storage portion, cause the lock mechanism to regulate detachment of the developer storage portion; and a second release processing portion configured to, when the detection circuit has detected a second state where there is at least one attachment portion to which a developer storage portion of the specific type has not been attached, and all of the plurality of lock mechanisms are regulating detachment of the developer storage portions, cause all of the plurality of lock mechanisms to release regulation of detachment of the developer storage portions.

2. The image forming apparatus according to claim 1, wherein each of the developer storage portions of the specific type includes:

a protruding portion having insulation, protruding from an end portion of each of the developer storage portions on a downstream side in an attachment direction in which each of the developer storage portions is attached to the image forming apparatus, the protruding portion protruding in the attachment direction, each of the plurality of detection electrodes includes:

a pair of metal terminals that are provided to be in contact with each other, wherein when a developer storage portion of the specific type is attached to a corresponding attachment portion, the protruding portion is inserted between the pair of metal terminals such that the pair of metal terminals are separated from each other, in the detection circuit, all of the plurality of detection electrodes are connected in parallel, and the regulation processing portion and the second release processing portion, in a case where the detection circuit is not conducted, determine that the detection circuit has detected the first state, and in a case where the detection circuit is conducted, determine that the detection circuit has detected the second state.

3. The image forming apparatus according to claim 1, wherein each of the developer storage portions of the specific type includes:

a protruding portion having conductivity, protruding from an end portion of each of the developer storage portions on a downstream side in an attachment direction in which each of the developer storage portions is attached to the image forming apparatus, the protruding portion protruding in the attachment direction, each of the plurality of detection electrodes includes:

a pair of metal terminals that are provided to be separated from each other, wherein when a developer storage portion of the specific type is attached to a corresponding attachment portion, the protruding portion is inserted between the pair of metal terminals such that the pair of metal terminals are electrically connected with each other via the protruding portion, in the detection circuit, all of the plurality of detection electrodes are connected in series, and the regulation processing portion and the second release processing portion, in a case where the detection circuit is conducted, determine that the detection circuit has detected the first state, and in a case where the detection circuit is not conducted, determine that the detection circuit has detected the second state.

4. The image forming apparatus according to claim 1, further comprising:

a notification processing portion configured to, in a case where the detection circuit has detected the second state, and all of the plurality of lock mechanisms are regulating detachment of the developer storage portions, notify that an attachment failure has occurred in any of the attachment portions, and in a case where the detection circuit has detected the second state, and there is a lock mechanism that is not regulating detachment of a developer storage portion, notify that there is an attachment portion to which a developer storage portion of the specific type has not been attached.

5. The image forming apparatus according to claim 1, further comprising:

a print control portion configured to, in a case where the detection circuit has detected the second state and a predetermined permission period has elapsed, restrict execution of a print process until the detection circuit detects the first state, the permission period extending from a time when the second release processing portion released regulation of detachment of the developer storage portions the most lately to a time when a predetermined end condition is satisfied.

6. A method implemented to release detachment regulation of a developer storage portion(s) in an image forming apparatus that includes a plurality of attachment portions to each of which a developer storage portion storing developer used for printing is attached, a plurality of lock mechanisms respectively provided in correspondence with the plurality of attachment portions and each configured to regulate detachment of a developer storage portion attached to a corresponding one of the plurality of attachment portions, a plurality of detection electrodes respectively provided in correspondence with the plurality of attachment portions and each configured to switch its status between being conducted and being not conducted when a developer storage portion of a predetermined specific type is attached to a corresponding attachment portion, and a detection circuit in which all of the plurality of detection electrodes are connected in series or in parallel and which is configured to detect whether or not developer storage portions of the specific type are attached to all of the plurality of attachment portions, the method comprising:

detecting whether or not any one of the plurality of attachment portions is in a specific state where a remaining amount of toner stored in a developer storage portion attached to the attachment portion is smaller than a predetermined lower-limit amount;

when the detecting has detected that one of the plurality of attachment portions is in the specific state, causing a lock mechanism corresponding to the attachment portion in the specific state, to release regulation of detachment of a developer storage portion attached to the attachment portion in the specific state;

when the detection circuit has detected a first state where developer storage portions of the specific type are attached to all of the plurality of attachment portions, and there is a lock mechanism that is not regulating detachment of a developer storage portion, causing the lock mechanism to regulate detachment of the developer storage portion; and when the detection circuit has detected a second state where there is at least one attachment portion to which a developer storage portion of the specific type has not been attached, and all of the plurality of lock mechanisms are regulating detachment of the developer storage portions, causing all of the plurality of lock mechanisms to release regulation of detachment of the developer storage portions.

* * * * *